US008730279B2

(12) United States Patent
Kajiyama et al.

(10) Patent No.: US 8,730,279 B2
(45) Date of Patent: May 20, 2014

(54) DISPLAY DEVICE AND MANUFACTURING METHOD THEREOF

(75) Inventors: Kenta Kajiyama, Yotsukaido (JP); Hajime Akimoto, Kokubunji (JP)

(73) Assignee: Pixtronix, Inc., San Diego, CA (US)

( * ) Notice: Subject to any disclaimer, the term of this patent is extended or adjusted under 35 U.S.C. 154(b) by 176 days.

(21) Appl. No.: 13/470,456

(22) Filed: May 14, 2012

(65) Prior Publication Data

US 2012/0293564 A1 Nov. 22, 2012

(30) Foreign Application Priority Data

May 16, 2011 (JP) ..... 2011-109441

(51) Int. Cl.
*G09G 5/10* (2006.01)
*G09G 5/00* (2006.01)

(52) U.S. Cl.
USPC ..... 345/690; 345/212

(58) Field of Classification Search
USPC ..... 345/690, 691, 697, 589, 211, 212
See application file for complete search history.

(56) References Cited

U.S. PATENT DOCUMENTS 6,563,486 B2 5/2003 Otobe et al.
7,460,290 B2 12/2008 Hagood, IV et al.
2007/0064008 A1* 3/2007 Childers ..... 345/589
2008/0259099 A1* 10/2008 Arai et al. ..... 345/690
2009/0066620 A1* 3/2009 Russell et al. ..... 345/88

FOREIGN PATENT DOCUMENTS

JP 10-31455 2/1998
JP 2008-197668 8/2008

OTHER PUBLICATIONS

European Search Report—EP12168089—Search Authority—Hague—Nov. 9, 2012.

* cited by examiner

*Primary Examiner* — Michael Faragalla
(74) *Attorney, Agent, or Firm* — Edward A. Gordon; Foley & Lardner LLP

(57) ABSTRACT

Provided are a display device that can suppress occurrence of a color breakup as well as occurrence of a false contour, and a control method therefor. In the display device, a plurality of sub-frame periods forming one frame period are divided into: a first group to which sub-frame periods with the same length of light transmission periods belong; and a second group to which sub-frame periods with lengths of light transmission periods shorter than those of the sub-frame periods in the first group and different from each other belong. Further, among the sub-frame periods that belong to the first group, sub-frame periods having the light transmission period increase in number from a middle of the one frame period toward a start point and an end point of the one frame period in accordance with an increase of the gray level.

11 Claims, 33 Drawing Sheets

PIXEL A

DISPLAY DEVICE AND MANUFACTURING METHOD THEREOF

CROSS-REFERENCE TO RELATED APPLICATION

The present application claims priority from Japanese application JP 2011-109441 filed on May 16, 2011, the content of which is hereby incorporated by reference into this application.

BACKGROUND OF THE INVENTION

1. Field of the Invention

The present invention relates to a display device and a control method therefor, and more particularly, to a grayscale display using an element for switching transmission and non-transmission of light.

2. Description of the Related Art

Japanese Patent Application Laid-open No. 2008-197668 discloses a display device including a micro-shutter called a "micro-electro-mechanical system (MEMS) shutter" for each pixel. This type of display device employs a field sequential system in which a plurality of light sources of different colors are turned on in a sequential manner.

SUMMARY OF THE INVENTION

In reviewing a grayscale display in the display device described above, the inventors of the present invention conceived a first referential example as follows. FIG. 22 is a diagram illustrating a turn-on period of a light source in the first referential example. In the first referential example, one frame period for displaying one image is divided into a red (R) sub-frame period (SF1 to SF8), a green (G) sub-frame period (SF9 to SF16), and a blue (B) sub-frame period (SF17 to SF24). Each sub-frame period includes an address period and a turn-on period. The address period is a period for writing data of the whole pixels and moving a shutter. A length of the turn-on period included in each sub-frame period is weighted according to a binary number system. A grayscale is expressed by controlling transmission and non-transmission of light emitted during the turn-on period with a shutter (when the number of bits is eight, 256 gray levels can be expressed). FIG. 23 is a diagram illustrating a light transmission period in the first referential example. The light transmission period is a period for which the light source is turned on and the shutter is opened. In FIG. 23, a hatched or black cell represents an opened period of the shutter and a white cell represents a closed period of the shutter. The light from the light source transmits in the opened period of the shutter and does not transmit in the closed period of the shutter.

However, it has been found that, when the first referential example is applied, a false contour is likely to occur. The false contour is a phenomenon that a contrast boundary that does not actually exist appears. FIG. 24 is a graph showing an occurrence of the false contour, which is a graph showing an analysis result of simulating a false contour occurring when scrolling a pattern being switched from gray level 128 to gray level 127 from right to left on a screen. The horizontal axis represents position in the visual field at a part at which the gray level is switched, and the vertical axis represents brightness ratio with respect to gray level 128. As shown in FIG. 24, in this case, a bright contour appears separately for RGB. FIGS. 25A and 25B are diagrams illustrating a principle of the false counter occurrence. A driving sequence of sub-frame periods 1, 2, 4, and 8 with a ratio of turn-on periods

1:2:4:8 is assumed. In FIGS. 25A and 25B, the horizontal axis represents time and the vertical axis represents position, and in one frame period, a pixel A of gray level 7 and a pixel B of gray level 8 are adjacent to each other. Numbers written in boxes indicate lengths of the sub-frame periods, and hatched portions and the non-hatched portions indicate transmission and non-transmission of the light, respectively. Arrows indicate movements of the line of sight. When looking at an area in which the pixel A of gray level 7 and the pixel B of gray level 8 are adjacent to each other, if the line of sight is not moved as illustrated in FIG. 25A, the pixel A of gray level 7 is recognized with a brightness of 1+2+4=7 and the pixel B of gray level 8 is recognized with a brightness of 8. However, if the line of sight moves as illustrated in FIG. 25B, the line of sight moves across the boundary between the adjacent pixels, and hence it is recognized with a brightness of 15 or 0, and as a result, a contour of gray level 15 or gray level 0 appears between the pixel A of gray level 7 and the pixel B of gray level 8. This problem occurs when a sub-frame period having a turn-on period and a sub-frame period having no turn-on period are switched with each other (i.e., 1, 2, and 4 are switched from turn-on to turn-off and 8 is switched from turn-off to turn on).

To cope with the problem of false contour, the inventors took a reference to Japanese Patent Application Laid-open No. Hei 10-31455 in the field of a plasma display. In FIG. 6 of Japanese Patent Application Laid-open No. Hei 10-31455, a turn-on method is disclosed in which sub-frame periods having a turn-on period increase in number from the center of a frame period toward a start point and an end point in accordance with an increase of the gray level. FIGS. 26A and 26B accompanied by the present specification are diagrams illustrating a suppression of the false contour by applying this turn-on method. In FIGS. 26A and 26B, a pixel A of gray level 3 and a pixel B of gray level 4 are adjacent to each other, and a view with the line of sight fixed as shown in FIG. 26A and a view with the line of sight moved as shown in FIG. 25B are shown. Even when the line of sight is moved in the above-mentioned manner, no false contour occurs because an intermediate brightness is obtained between the pixel A of gray level 3 and the pixel B of gray level 4. It is due to a fact that there is no switching of sub-frame periods to be turned on. In FIGS. 27 and 52 of Japanese Patent Application Laid-open No. Hei 10-31455, a turn-on method is further disclosed in which sub-frame periods are divided into a group for representing a large change of brightness and a group for representing a small change of brightness.

With reference to Japanese Patent Application Laid-open No. Hei 10-31455 described above, the inventors of the present invention conceived a second referential example as follows. FIG. 27 is a diagram illustrating a light transmission period in the second referential example. FIG. 27 illustrates sub-frame periods of one color. In the second referential example, the sub-frame periods are divided into a first group in which lengths of light transmission periods are the same and a second group in which lengths of light transmission periods are shorter than those of the first group and different from each other, and the sub-frame periods of the first group having the light transmission period increase in number from the middle of one frame period toward a start point and an end point in accordance with an increase of the gray level. Unlike a plasma display, a field sequential system is employed in the above-mentioned display device. Therefore, in the second referential example, sub-frame groups are provided as illustrated in FIG. 27 for each color, and these sub-frame groups are arranged sequentially in one frame period. The reason is because, when a suppression of the false contour is only considered, it is preferred to arrange the sub-frame periods having the light transmission periods as close as possible for each color.

However, in the second referential example described above, it has been found that a problem of color breakup occurs. The color breakup is a phenomenon that any one of colors (for example, RGB) constituting a white color appears when the white color is displayed. FIG. 28 is a diagram illustrating an occurrence of the color breakup. In FIG. 28, the horizontal axis represents time, and the vertical axis represents position of pixel. Pixels A to E are arranged in a direction of the vertical axis, and a turn-on status of each pixel is shown in a direction of the horizontal axis. The arrows indicate a movement of the line of sight. When the pixel C is set to white and the other pixels are set to black in a driving sequence of turning on RGB in a sequential manner in one frame, if the line of sight is not moved, the pixel C is recognized as white and the other pixels are recognized as black. However, if the line of sight is moved, a timing of turning on each color is shifted in the visual field, resulting in the pixel C being recognized with separated RGB instead of white. This is a principle of the color breakup occurrence. The problem of color breakup described above does not occur in a plasma display disclosed in Japanese Patent Application Laid-open No. Hei 10-31455 described above.

The present invention has been made in view of the above-mentioned actual situations, and it is a primary object of the present invention to provide a display device that can suppress occurrence of a color breakup and occurrence of a false contour, and to provide a control method therefor.

In order to solve the above-mentioned problems, according to an exemplary embodiment of the present invention, a display device includes: a light source for emitting light of a plurality of colors; an element provided on each pixel, for switching transmission and non-transmission of the light from the light source; and a control unit for driving the light source and the element. The control unit represents a gray level based on presence and absence of a light transmission period in each of a plurality of sub-frame periods constituting one frame period for displaying one image. The plurality of sub-frame periods are divided into: a first group to which sub-frame periods with the same lengths of light transmission periods belong; and a second group to which sub-frame periods with lengths of light transmission periods shorter than the lengths of the light transmission periods of the sub-frame periods in the first group and different from each other belong. Among the sub-frame periods that belong to the first group, sub-frame periods having the light transmission period increase in number from a middle of the one frame period toward a start point and an end point of the one frame period in accordance with an increase of the gray level. The each of the plurality of sub-frame periods includes a plurality of light transmission periods in which the light of the plurality of colors transmits, respectively.

According to the present invention, the sub-frame periods of the first group having the light transmission period increase in number from the middle of the one frame period toward the start point and the endpoint in accordance with the increase of the gray level, and hence occurrence of the false contour can be suppressed. Further, each of the sub-frame periods includes a plurality of light transmission periods, in which the light of the plurality of colors transmits, respectively, and hence occurrence of the color breakup can also be suppressed.

DETAILED DESCRIPTION OF THE INVENTION

Embodiments of a display device and a control method therefor according to the present invention are described in detail below with reference to accompanying drawings.

Figure 1:
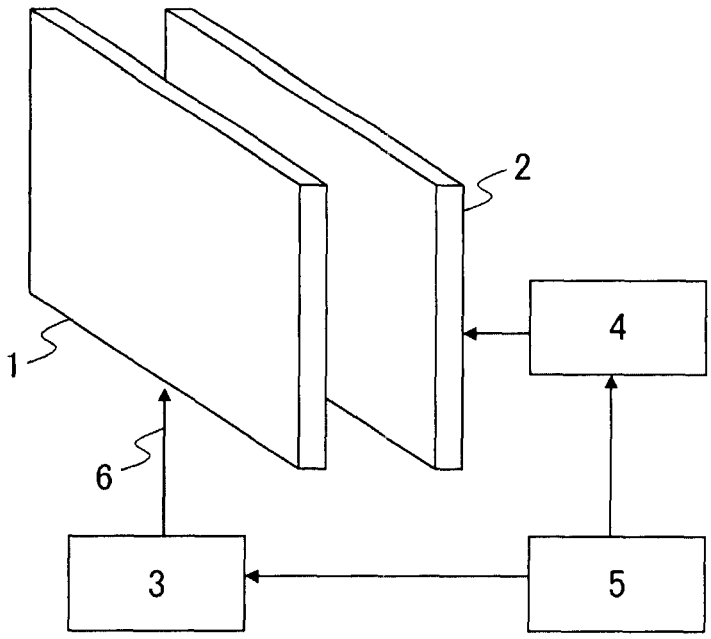
FIG. 1 is a diagram illustrating a configuration example of a display device according to the present invention.

FIG. 1 is a diagram illustrating a configuration example of a display device according to the present invention. The display device according to the present invention is a display device using a turn-on control element such as a MEMS shutter, which includes a glass substrate 1, a backlight unit 2, a display control circuit 3, an emission control circuit 4, and a system control circuit 5. The glass substrate 1 includes the turn-on control element such as the MEMS shutter, and a pixel circuit and a peripheral circuit for driving the turn-on control element. The backlight unit 2 is a light source for illuminating a display region of the glass substrate 1, which includes LEDs of a plurality of colors such as RGB. The display control circuit 3 controls the circuits provided on the glass substrate 1, and the emission control circuit 4 controls a turn-on operation of the backlight unit 2. The system control circuit 5 controls the display control circuit 3 and the emission control circuit 4.

Figure 2:
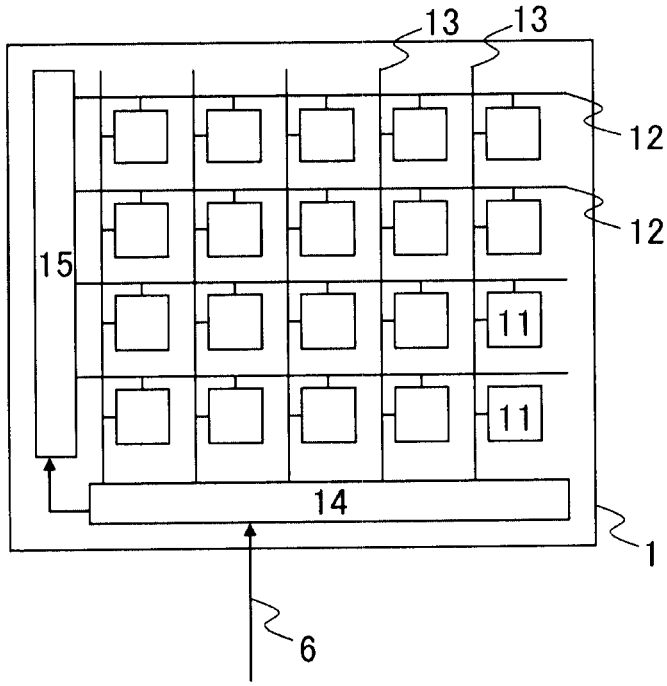
FIG. 2 is a diagram illustrating a configuration example of a glass substrate of the display device.

FIG. 2 is a diagram illustrating a configuration example of the glass substrate 1. On the glass substrate 1, a plurality of pixels 11, a row selecting circuit 15, and an integrated circuit 14 are disposed. The pixels 11 are arranged in a matrix form on the glass substrate 1, and each of the pixels 11 includes the turn-on control element for switching transmission and non-transmission of light from the backlight unit 2, and the pixel circuit for driving the turn-on control element. A row selection signal line 12 extending from the row selecting circuit 15 and a data signal line 13 extending from the integrated circuit 14 are connected to each of the pixels 11. A video signal output from the integrated circuit 14 is stored in a memory capacitance of a pixel 11 selected by the row selecting circuit 15. The row selecting circuit 15 is controlled by the integrated circuit 14, and the integrated circuit 14 is controlled by the display control circuit 3, which is externally provided, via a control line 6 such as an FPC.

Figure 3:
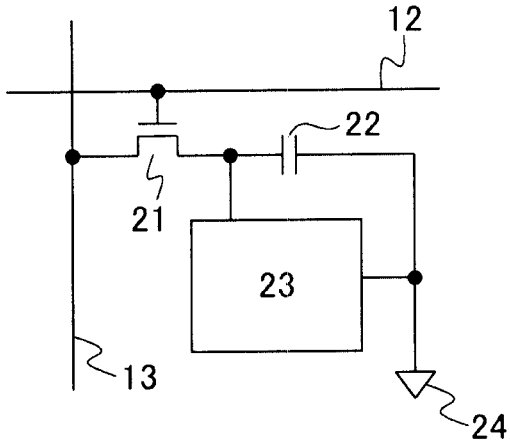
FIG. 3 is a diagram illustrating a configuration example of a pixel of the display device.

FIG. 3 is a diagram illustrating a configuration example of the pixel 11. A switch 21 is connected to the row selection signal line 12, and when the switch 21 is turned on, a voltage of the data signal line 13 is written in a memory capacitance 22. The memory capacitance 22 is connected to the switch 21 and a reference potential 24, and a turn-on control element 23 is operated by the voltage written in the memory capacitance 22. The turn-on control element 23 is a MEMS shutter that performs a switching between transmission and non-transmission of light from the backlight unit 2. For example, the MEMS shutter is operated to open and close an aperture through which the light from the backlight unit 2 transmits.

An embodiment of a driving sequence in one frame period (for example, 16.67 ms) in the display device according to the present invention is described below. Although each embodiment describes an example in which the number of gray levels is 64 (6 bits), the number of gray levels is not limited thereto, and the similar driving sequence can be applied even when the number of gray levels increases or decreases.

[First Embodiment]

Figure 4A:
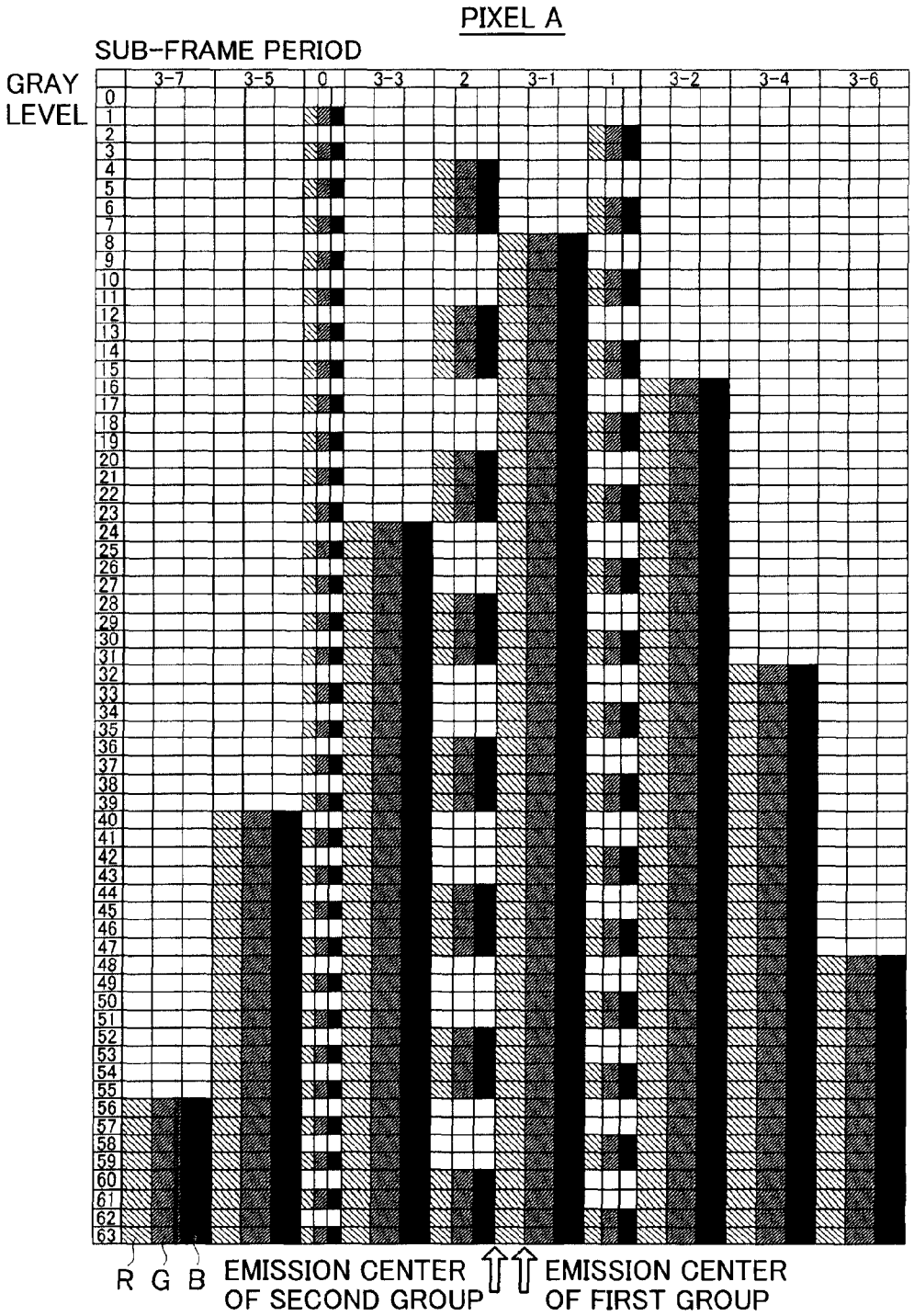
FIG. 4A is a diagram illustrating a driving sequence of a pixel A according to a first embodiment of the present invention.
Figure 4B:
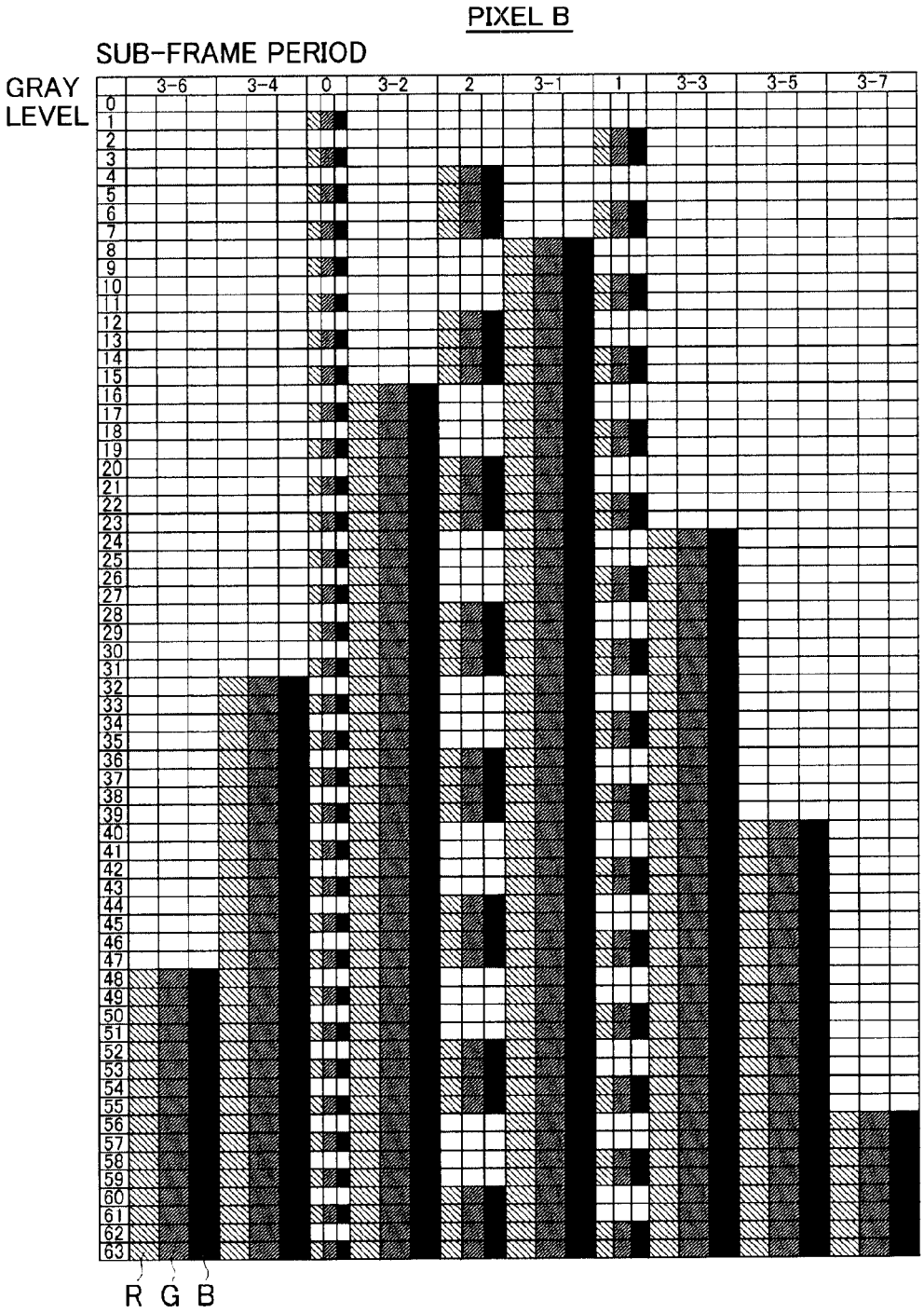
FIG. 4B is a diagram illustrating a driving sequence of a pixel B according to the first embodiment.

FIGS. 4A and 4B are diagrams illustrating driving sequences according to a first embodiment of the present invention. FIG. 4A illustrates a driving sequence of a pixel A, and FIG. 4B illustrates a driving sequence of a pixel B. The vertical axis of FIGS. 4A and 4B represents displayable gray levels, and numbers of the gray levels are shown in the left-most column. The number of the gray level increases toward the bottom of FIGS. 4A and 4B. The horizontal axis of FIGS. 4A and 4B represents one frame period for displaying one image, and numbers of sub-frame periods constituting the one frame period are shown in the uppermost row. In FIGS. 4A and 4B, the left side corresponds to a start point side of the one frame period and the right side corresponds to an end point side of the one frame period. Each of the sub-frame periods includes light transmission periods for colors of RGB. In this embodiment, the light transmission periods for the colors of RGB are repeated with a short cycle in the order of RGB. In the case of using the MEMS shutter, the light transmission period is a period during which the backlight unit 2 is turned on and the MEMS shutter is opened. FIGS. 4A and 4B illustrate which of the light transmission periods of the sub-frame periods corresponds to light emission in each of the gray levels. In this manner, each of the gray levels is represented by presence and absence of the light transmission period in each of the sub-frame periods. Although FIGS. 4A and 4B illustrate an example in which the respective colors have the same gray level (R=G=B), when the gray levels of the respective colors differ from each other, a turn-on pattern for each of the colors is applied. In addition, although not shown, an address period is provided between every two adjacent light transmission periods in actual cases.

The sub-frame periods are divided into sub-frame periods 3-1 to 3-7 that belong to a first group and sub-frame periods 0 to 2 that belong to a second group. The sub-frame periods 3-1 to 3-7 that belong to the first group have the same length of the light transmission period. In this embodiment, the length of the light transmission period is 3 bits. The number "3" at the head of 3-1 to 3-7 indicates the length of 3 bits, and the numbers "1 to 7" at the tail indicates an order of the light transmission periods appearing in accordance with an increase of the gray level. In the first group, the number of sub-frame periods in which the light transmission period appears increases every time the gray level reaches multiples of 8. In the sub-frame periods 0 to 2 that belong to the second group, the lengths of the light transmission periods are shorter than that of the light transmission period of the first group, and weighted to differ from each other. In this embodiment, the lengths of the light transmission periods of the second group are 0 bits to 2 bits. The numbers "0 to 2" indicate that the lengths are 0 bits to 2 bits. In the sub-frame periods 0 to 2 that belong to the second group, a pattern of a combination of light transmission periods having the lengths corresponding to each of the gray levels appears during the gray level reaches eight, and this pattern is repeated every time the gray level reaches multiples of 8. The sub-frame periods 3-1 to 3-7 that belong to the first group are referred to as a turn-on control unit, and the sub-frame periods 0 to 2 that belong to the second group are referred to as a bit control unit.

Among the sub-frame periods 3-1 to 3-7 that belong to the first group, the sub-frame periods in which the light transmission period appears increase in number from the middle of the one frame period toward the start point and the end point in accordance with an increase of the gray level, and are arranged to form a pyramid-like shape as a whole. In this case, the sub-frame periods in which the light transmission period appears increase in number on the start point side and the end point side in an alternate manner. For example, the sub-frame period 3-1 in which the light transmission period appears at the lowest gray level is arranged at the center portion of the one frame period. The sub-frame period 3-2 in which the light transmission period appears at the second lowest gray level is arranged on the start point side or the end point side of the one frame period with respect to the sub-frame period 3-1. In this embodiment, in the pixel A shown in FIG. 4A, the sub-frame period 3-2 is arranged on the end point side of the one frame period with respect to the sub-frame period 3-1, and in the pixel B shown in FIG. 4B, the sub-frame period 3-2 is arranged on the start point side of the one frame period with respect to the sub-frame period 3-1. The sub-frame period 3-3 in which the light transmission period appears at the third lowest gray level is arranged on the opposite side to the sub-frame period 3-2 with respect to the sub-frame period 3-1. The sub-frame period 3-4 in which the light transmission period appears at the fourth lowest gray level is arranged on the same side as the sub-frame period 3-2 with respect to the sub-frame period 3-1 farther away from the sub-frame period 3-1 than the sub-frame period 3-2. The subsequent sub-frame periods 3-5 to 3-7 are also arranged according to the above-mentioned rule. The same goes for a case where the number of gray levels is larger than 64 (6 bits).

Each of the sub-frame periods 0 to 2 that belong to the second group is arranged between adjacent two of the sub-frame periods 3-1 to 3-7 that belong to the first group. That is, the sub-frame periods 3-1 to 3-7 that belong to the first group and the sub-frame periods 0 to 2 that belong to the second group are arranged in an alternate manner. In this embodiment, the sub-frame periods 0 to 2 that belong to the second group are arranged around the center of the one frame period, and two of the sub-frame periods 0 to 2 are arranged before and after the sub-frame period 3-1 that is arranged at the center portion of the one frame period, so as to sandwich the sub-frame period 3-1.

In the pixel A shown in FIG. 4A and the pixel B shown in FIG. 4B, the sides on which the sub-frame periods 3-2 to 3-7 are arranged are opposite to each other with respect to the sub-frame period 3-1. That is, in the pixel A shown in FIG. 4A, the sub-frame periods 3-2, 3-4, and 3-6 are arranged on the end point side of the one frame period with respect to the sub-frame period 3-1 and the sub-frame periods 3-3, 3-5, and 3-7 are arranged on the start point side of the one frame period with respect to the sub-frame period 3-1, whereas in the pixel B shown in FIG. 4B, the sub-frame periods 3-2, 3-4, and 3-6 are arranged on the start point side of the one frame period with respect to the sub-frame period 3-1 and the sub-frame periods 3-3, 3-5, and 3-7 are arranged on the end point side of the one frame period with respect to the sub-frame period 3-1. In this manner, in the pixel A shown in FIG. 4A and the pixel B shown in FIG. 4B, the sub-frame periods 3-1 to 3-7 that belong to the first group are arranged in a symmetric manner with respect to the center in a direction of time elapse in the one frame period. Note that, the sub-frame periods 0 to 2 that belong to the second group are arranged at the same positions (positions in the one frame period) in the pixel A shown in FIG. 4A and the pixel B shown in FIG. 4B and appear at the same timings.

Figure 5:
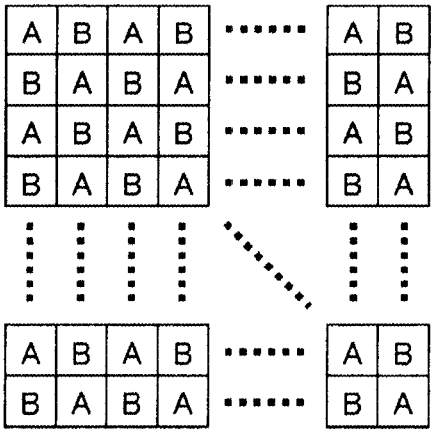
FIG. 5 is a diagram illustrating an arrangement of the pixel A and the pixel B.

FIG. 5 is a diagram illustrating an arrangement of the pixel A and the pixel B. In FIG. 5, a letter "A" is assigned to the pixel A that operates in the driving sequence of FIG. 4A and a letter "B" is assigned to the pixel B that operates in the driving sequence of FIG. 4B. The pixel A and the pixel B are arranged two-dimensionally in an alternate manner. Specifically, the pixel A and the pixel B are arranged in a checked pattern. That is, each of the pixel A and the pixel B is arranged in a zigzag shape and one is fitted into the other such that a pixel of one of the pixel A and the pixel B is surrounded by four pixels of the other of the pixel A and the pixel B. As the zigzag pattern is not recognized particularly with 200 ppi or larger, this method is effective.

The pixel A and the pixel B can be controlled so that the pixel A and the pixel B switch places for each frame period. That is, a pixel corresponding to the pixel A that operates in the driving sequence of FIG. 4A in a certain frame period becomes the pixel B that operates in the driving sequence of FIG. 4B in the next frame period, and becomes the pixel A that operates in the driving sequence of FIG. 4A in the frame period after the next.

Figure 6A:
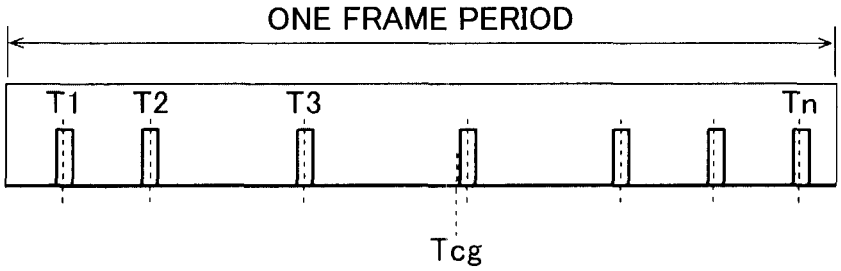
FIG. 6A is a diagram illustrating a method of calculating an emission center of a first group.
Figure 6B:
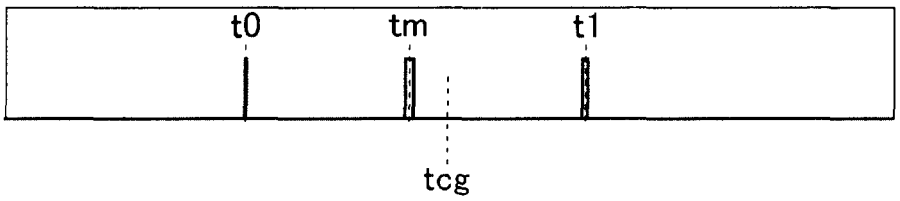
FIG. 6B is a diagram illustrating a method of calculating an emission center of a second group.

FIG. 6A is a diagram illustrating a method of calculating an emission center of the first group, and FIG. 6B is a diagram illustrating a method of calculating an emission center of the second group. FIG. 6A illustrates an emission waveform of the light transmission period of G included in the sub-frame periods 3-1 to 3-7 of the first group, and FIG. 6B illustrates an emission waveform of the light transmission period of G included in the sub-frame periods 0 to 2 of the second group. FIGS. 6A and 6B illustrate emission waveforms at the time of the maximum gray level. The emission brightness of each of the emission waveforms is a constant value, and the brightness of the one frame period is determined by a length of an emission time period.

In FIG. 6A, there are n emissions in the one frame period, and the emission centers of the emissions are denoted by T1, T2, . . . , and Tn sequentially from the start point side. The emission time period is the same for all the emissions with emission brightness of L. When a time period from the start point of the one frame period to the emission center of the whole sub-frame periods that belong to the first group is represented by Tcg, Tcg is determined by Equation 1 below.

$$L\times(T1-Tcg)+L\times(T2-Tcg)+L\times(T3-Tcg)+\ldots+L\times(Tn-Tcg)=0$$

$$L\times(T1+T2+T3+\ldots+Tn)-n\times L\times Tcg=0$$

$$Tcg=(T1+T2+T3+\ldots+Tn)/n \qquad \text{[Eq. 1]}$$

Similarly, in FIG. 6B, there are m emissions in the one frame period, and the emission centers of the emissions are denoted by t0, t1, . . . , and tm sequentially from the start point side. The emission brightness thereof are denoted by L0, L1, . . . , and Lm. When a time period from the start point of the one frame period to the emission center of the whole sub-frame periods that belong to the second group is represented by tcg, tcg is determined by Equation 2 below.

$$L0\times(t0-tcg)+L1\times(t1-tcg)+L2\times(t2-tcg)+\ldots+Lm\times(tm-tcg)=0$$

$$L0\times t0+L1\times t1+L2\times t2+\ldots+Lm\times tm-(L0+L1+L2+\ldots+Lm)\times tcg=0$$

$$tcg=(L0\times t0+L1\times t1+L2\times t2+\ldots+Lm\times tm)/(L0+L1+L2+\ldots+Lm) \qquad \text{[Eq. 2]}$$

For example, in a model calculated by the inventors of the present invention, when a period of one frame is 16.67 ms, Tcg is 8.87 ms, tcg is 8.10 ms, and Tcg−tcg is 0.77 ms. By the way, T1−T is 1.70 ms.

The problems of false contour and color breakup are suppressed as the emission centers are brought closer to each other, and hence it is preferred that the emission centers of the sub-frame periods 3-1 to 3-7 that belong to the first group and the emission centers of the sub-frame periods 0 to 2 that belong to the second group be as close as possible to each other. For example, it is preferred that the difference of the emission centers Tcg−tcg be shorter than the length of each of the sub-frame periods 3-1 to 3-7 that belong to the first group. The experiments conducted by the inventors of the present invention revealed that preferred suppression effects could be obtained when the difference Tcg−tcg was equal to or smaller than about 10% of the one frame period.

Figure 7A:
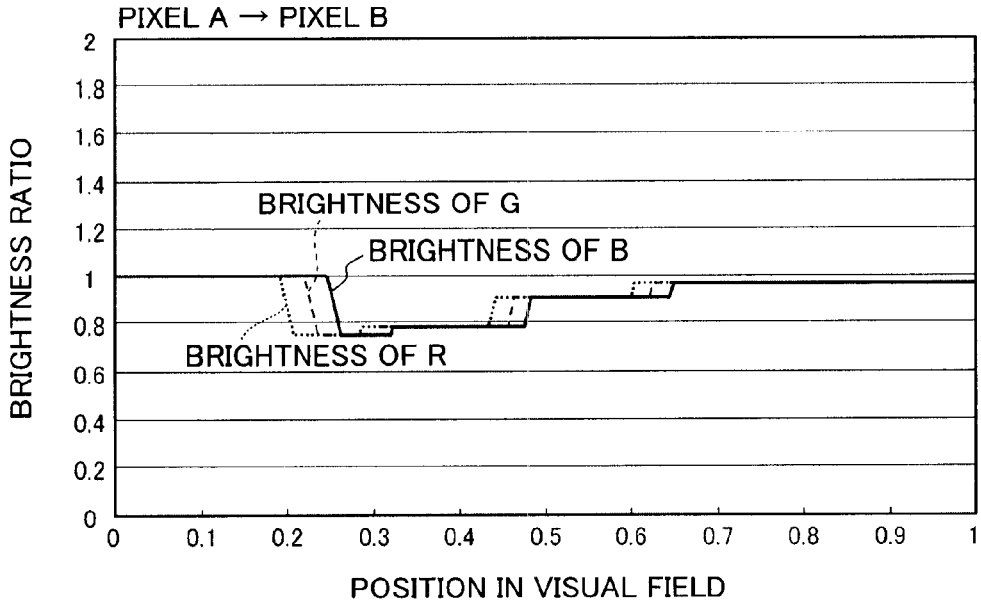
FIGS. 7A to 7C are graphs showing simulation results of simulating false contours in different conditions.
Figure 7B:
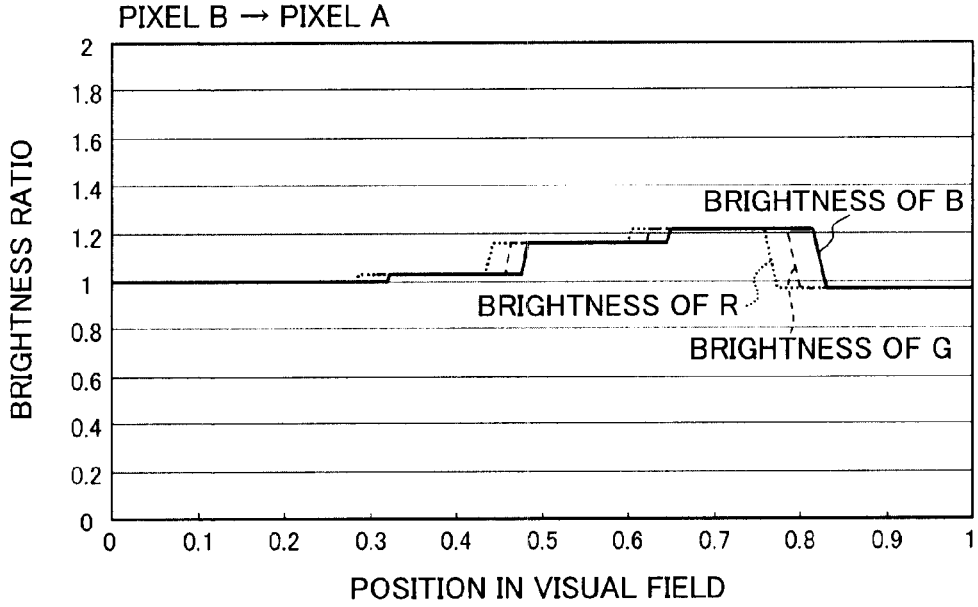
Figure 7C:
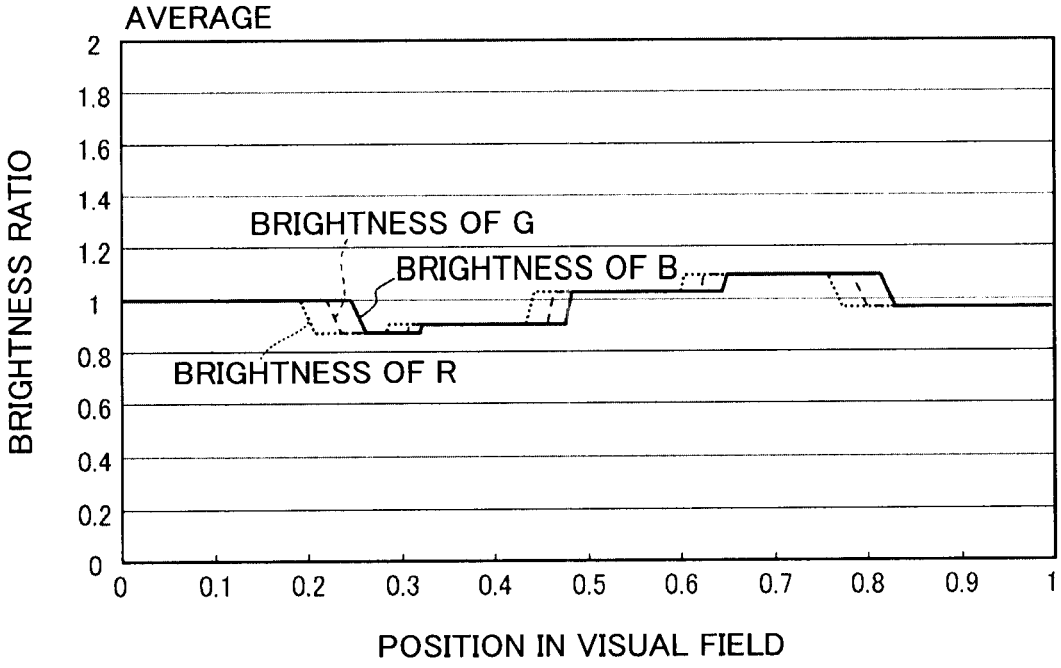

FIGS. 7A to 7C are graphs showing simulation results of simulating false contours in different conditions. FIG. 7A is a graph showing a result of a false contour simulation when the line of sight moves from the right to the left with respect to a pixel that makes a transition from gray level 32 of FIG. 4A to gray level 31 of FIG. 4B. The horizontal axis represents position in the visual field on the retina, and the vertical axis represents brightness ratio with respect to the brightness of gray level 32. When the brightness of gray level 32 changes to the brightness of gray level 31, although no problem occurs if a change is within the brightness between them, the false contour is recognized if the brightness is changed to brighter or darker level. Further, the resolution cannot be obtained on the retina as widths of the light and dark pulses become narrower, and hence the false contour becomes less noticeable. In FIG. 7A, a slightly dark false contour having a peak brightness ratio of below 0.8 and a width of the visual field position of about 0.4 occurs for each of RGB, and RGB are virtually overlapped.

FIG. 7B is a graph showing a result of a false contour simulation when the line of sight moves from the right to the left with respect to a pixel that makes a transition from gray level 32 of FIG. 4B to gray level 31 of FIG. 4A. Contrary to the case shown in FIG. 7A, a false contour slightly brighter than gray level 32 occurs.

FIG. 7C is a graph showing an average of the cases shown in FIGS. 7A and 7B. The pixel A and the pixel B are arranged in a checked pattern as illustrated in FIG. 5, the false contour of FIG. 7A and the false contour of FIG. 7B occur in two adjacent pixels, and about an average value is recognized between the adjacent pixels. Further, when the pixel A and the pixel B switch places for each frame period, the false contour of FIG. 7A and the false contour of FIG. 7B occur in an alternate manner for each frame period. From this point, it is presumed that a viewer can recognize the false contour of FIG. 7C, which is the average of the false contour of FIG. 7A and the false contour of FIG. 7B. Therefore, the problem of the false contour can be effectively improved.

The inversion of the brightness between the false contour of FIG. 7A and the false contour of FIG. 7B is caused by a fact that the arrangement of the sub-frame periods 3-1 to 3-7 that belong to the first group is reversed in the two driving sequences.

Figure 8:
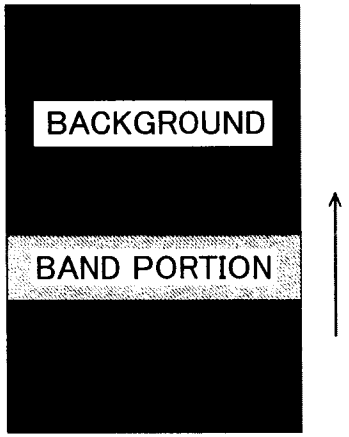
FIG. 8 is a diagram illustrating an evaluation pattern for evaluating a color breakup.

FIG. 8 is a diagram illustrating an evaluation pattern for evaluating a color breakup. The background is set to have gray level 0 for each of RGB, and a band portion is set to have gray level 32 for R, gray level 31 for G, and gray level 31 for B. The band portion is scrolled from the right to the left on the screen.

Figure 9A:
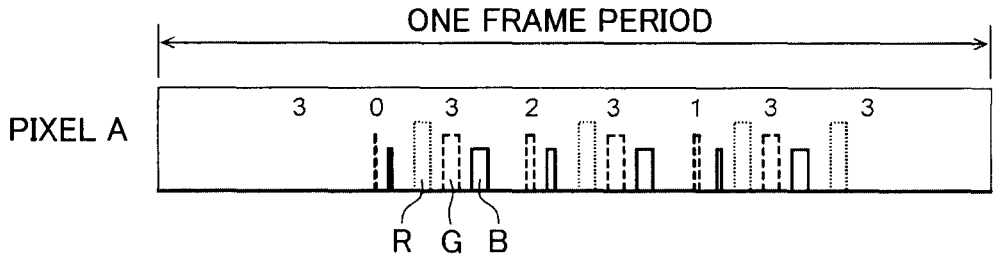
FIGS. 9A and 9B are diagrams illustrating emission waveforms in band portions of the evaluation pattern.
Figure 9B:
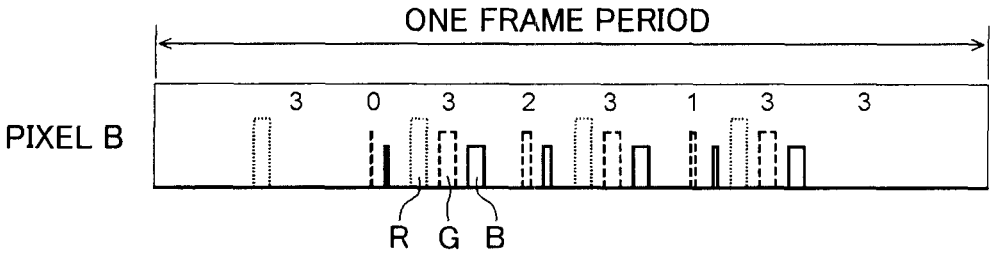

FIGS. 9A and 9B are diagrams illustrating emission waveforms in the band portion of the evaluation pattern. FIGS. 9A and 9B are diagrams illustrating the emission waveforms of the band portion with the driving sequences of FIGS. 4A and 4B. The left sides of FIGS. 9A and 9B correspond to the start point side of the one frame period, and the right sides of FIGS. 9A and 9B correspond to the endpoint side of the one frame period. In FIGS. 9A and 9B, heights of RGB are changed for a better view. The figures in FIGS. 9A and 9B represent emission time periods in units of bit. The sub-frame periods 3-1 to 3-7 that belong to the first group have the same emission time period with the bit representation of 3. The human eyes work continuously regardless of a blinking of the band portion, and the band portion blinks staying at the spot until the frame period is changed. Therefore, the blinking of the band portion is recognized in the visual field in a shifted manner. Therefore, it appears that the band portion is colored according to a turn-on sequence.

In FIG. 9A, all RGB are turned on in three sub-frame periods that belong to the first group at the center. The color is shifted in the sub-frame periods that belong to the second group, and it becomes a color intended by R in one of the sub-frame periods that belong to the first group on the end point side. That is, in FIG. 9A, a color breakup of cyan (Cy: G+B) occurs at forward of the scroll and a color breakup of R occurs at the backward of the scroll. In FIG. 9B, the order of turn-on increase in the sub-frame period of the first group is reversed, and hence the color is shifted at R in one of the sub-frame periods that belong to the first group on the start point side, and it becomes the intended color gradually in the sub-frame periods that belong to the second group. That is, in FIG. 9B, a color breakup of R occurs at the forward of the scroll and a color breakup of Cy occurs at the backward of the scroll. The pixel A and the pixel B are arranged in a checked pattern as illustrated in FIG. 5, and hence these color breakups are averaged, and as a result, the color breakup is effectively suppressed. In this embodiment, although the occurrence of the color breakup is suppressed by providing each of the sub-frame periods including the light transmission periods of RGB, the occurrence of the color breakup is further suppressed by arranging the pixel A and the pixel B in a checked pattern.

Figure 10A:
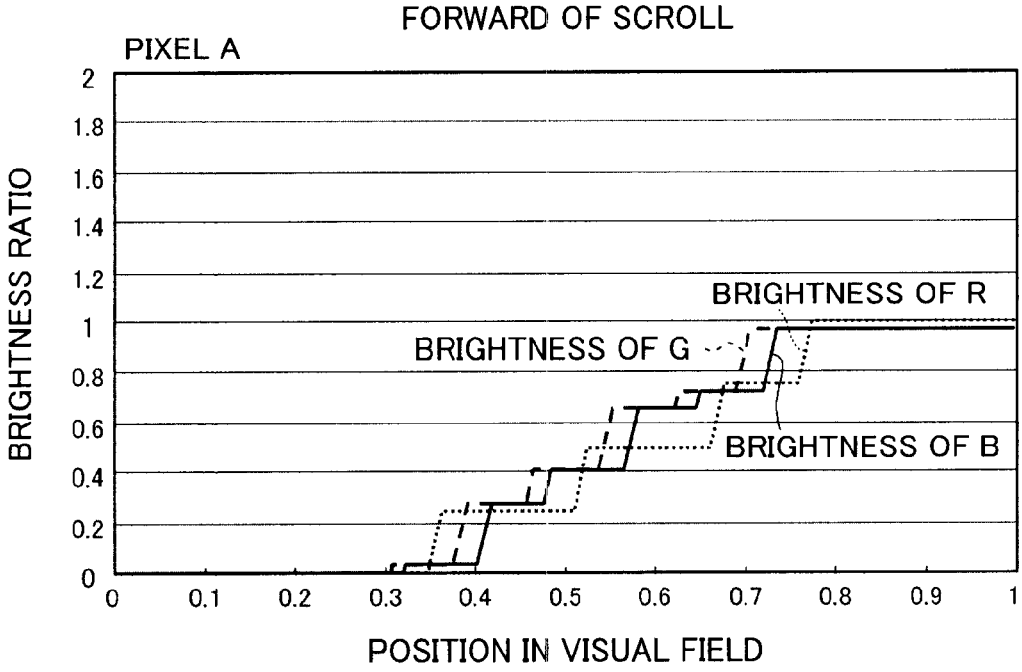
FIGS. 10A to 10F are graphs showing simulation results of simulating color breakups in different conditions.
Figure 10B:
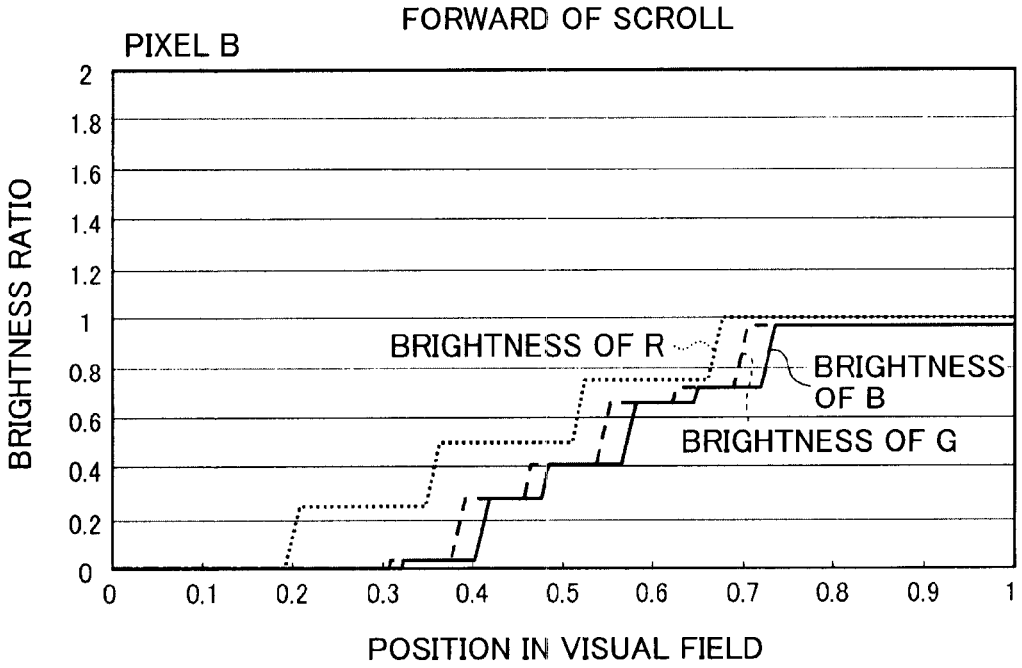
Figure 10C:
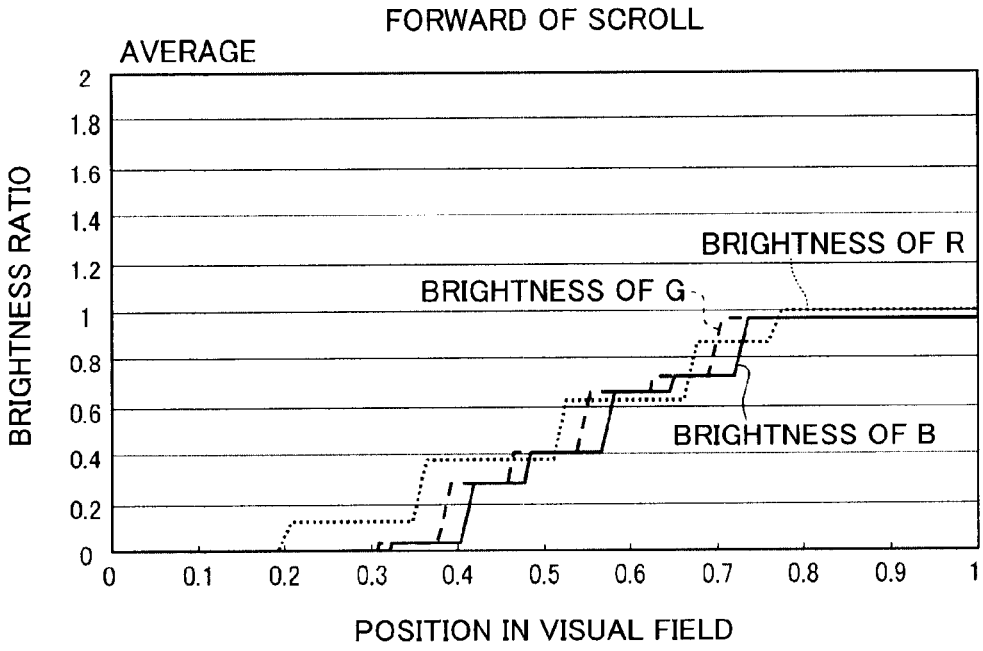
Figure 10D:
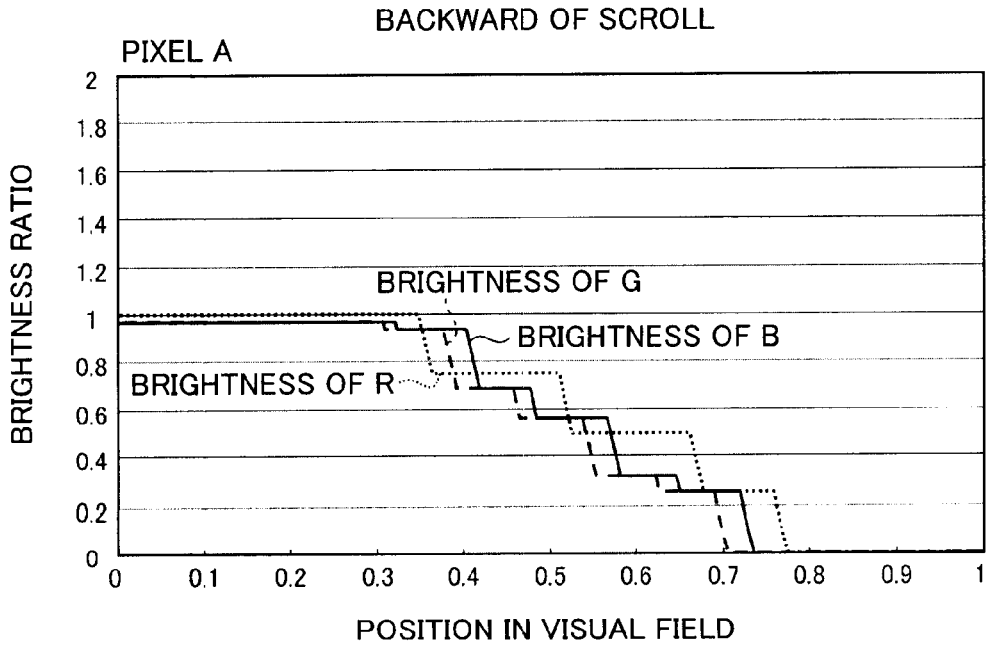
Figure 10E:
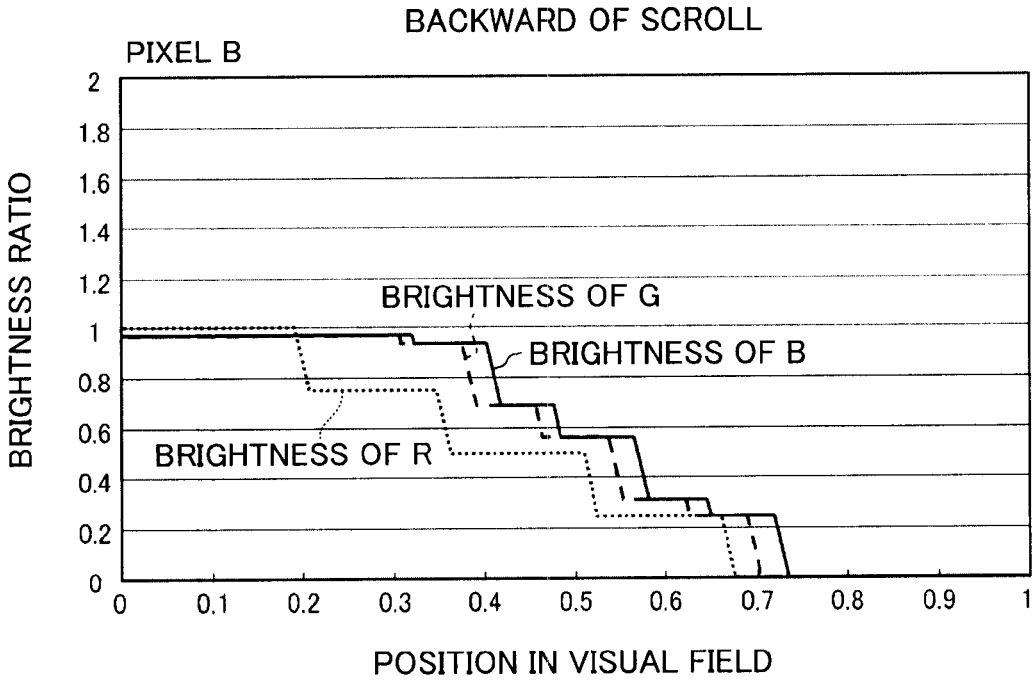
Figure 10F:
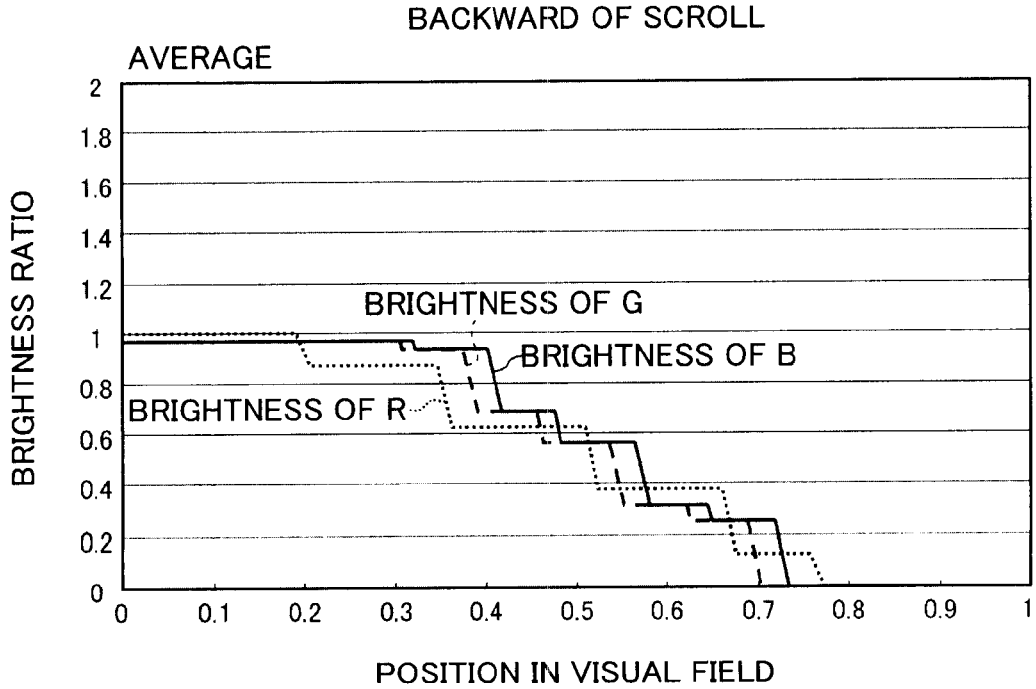

FIGS. 10A to 10F are graphs showing simulation results of simulating color breakups in different conditions. In FIGS. 10A to 10F, the brightness of the forward of the scroll and the backward of the scroll is shown for each of the pixel A, the pixel B, and the average of the pixel A and the pixel B. As described above, the pixel A and the pixel B are arranged in a checked pattern, and the pixel A and the pixel B further switch places for each frame period. Therefore, it is recognized on the average between adjacent pixels and between adjacent frame periods. Therefore, it is presumed that the human eyes can recognize as shown in FIGS. 10C and 10F.

In the pixel B, the color is biased toward R because the brightness of R is uniformly higher than the brightness of GB at the forward of the scroll as shown in FIG. 10B, and the color is biased toward Cy because the brightness of R is uniformly lower than the brightness of GB at the backward of the scroll as shown in FIG. 10E. In the pixel A, the color is slightly biased toward Cy at the forward of the scroll as shown in FIG. 10A, and the color is slightly biased toward R at the backward of the scroll as shown in FIG. 10D. On average, as shown in FIGS. 10C and 10F, it appears that the color bias is improved; however, it seems that a difference with the pixel A is small.

Results of obtaining areas surrounded by plots of R and G in the graphs of FIGS. 10A to 10F are as follows. The area is −0.029 in FIG. 10A, +0.113 in FIG. 10B, +0.042 in FIG. 10C, +0.060 in FIG. 10D, −0.082 in FIG. 10E, and −0.011 in FIG. 10F. In each of the values, + indicates that the color is biased toward R than G, and +0.03125 (=1/32) means that the color is biased toward R by one gray level in the whole visual field. The color of the band portion is biased toward R by one gray level, and it is changed from the background to the band portion in the middle of the visual field. Therefore, it is acceptable when the value is 0 to +0.03125. Comparing the values tells that the average is the best for sure. A distance to 0 to +0.03125 is as follows. The distance is −0.029 in FIG. 10A, +0.082 in FIG. 10B, +0.011 in FIG. 10C, +0.029 in FIG. 10D, −0.082 in FIG. 10E, and −0.011 in FIG. 10F.

As described above, through application of this embodiment, both the false contour and the color breakup can be effectively suppressed.

Although the driving sequences are switched for each frame period in this embodiment, the occurrence of the false contour can be suppressed such that the false contours are canceled between the pixel A and the pixel B without switching the driving sequences for each frame period. In addition, the number of gray levels is not limited to 64 (6 bits), and can be equal to or smaller than 32 (5 bits) or equal to or larger than 128 (7 bits). Further, the color is not limited to three colors of RGB, and can be RGBW or RGBY (Y: Yellow). Moreover, the display device is not limited to the MEMS display, and can be LCD or the like. The same goes for the other examples described below.

[Second Embodiment]

Figure 11:
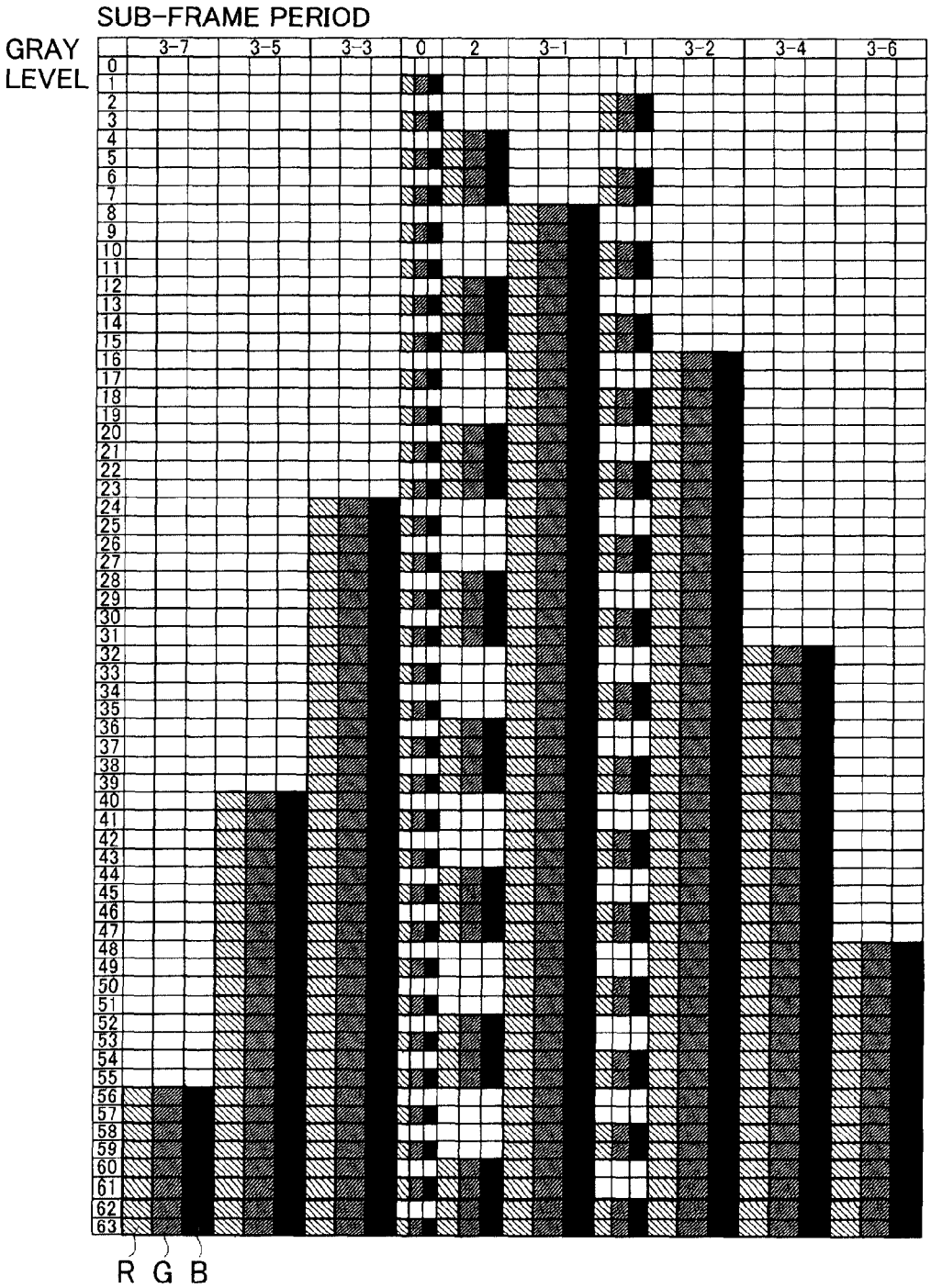
FIG. 11 is a diagram illustrating a driving sequence according to a second embodiment of the present invention.

FIG. 11 is a diagram illustrating a driving sequence according to a second embodiment of the present invention. The basic configuration and operation of a display device are virtually the same as those of the first embodiment, and hence a difference from the first embodiment is mainly described below.

In this embodiment, the sub-frame periods 0 to 2 that belong to the second group are arranged before and after the sub-frame period 3-1 in which the light transmission period appears at the lowest gray level, which is arranged at the center of one frame period among the sub-frame periods 3-1 to 3-7 that belong to the first group. The rest of the sub-frame periods 3-2 to 3-7 are arranged farther away from the sub-frame period 3-1 than the sub-frame periods 0 to 2 that belong to the second group. That is, the sub-frame periods 0 to 2 that belong to the second group are concentrated in the center portion of the one frame period, and the sub-frame period 3-1 is arranged between any two adjacent sub-frame periods among the sub-frame periods 0 to 2. None of the other sub-frame periods 3-2 to 3-7 that belong to the first group is arranged between the other sub-frame periods among the sub-frame periods 0 to 2.

In this embodiment, an interval between the sub-frame periods 0 to 2 that belong to the second group is narrower than that of the first embodiment, and hence the false contour and the color breakup caused by the sub-frame periods 0 to 2 that belong to the second group is more suppressed than the first embodiment.

Although not shown, in the same manner as FIGS. 4A and 4B, there may be provided a pixel A having the driving sequence of FIG. 11 and a pixel B in which arrangement of the sub-frame periods 3-1 to 3-7 that belong to the first group is opposite to that of the pixel A, and as illustrated in FIG. 5, the pixel A and the pixel B may be arranged in a checked pattern. Further, the pixel A and the pixel B may switch places for each frame period. Note that, the sub-frame periods 0 to 2 that belong to the second group are arranged at the same positions.

[Third Embodiment]

Figure 12:
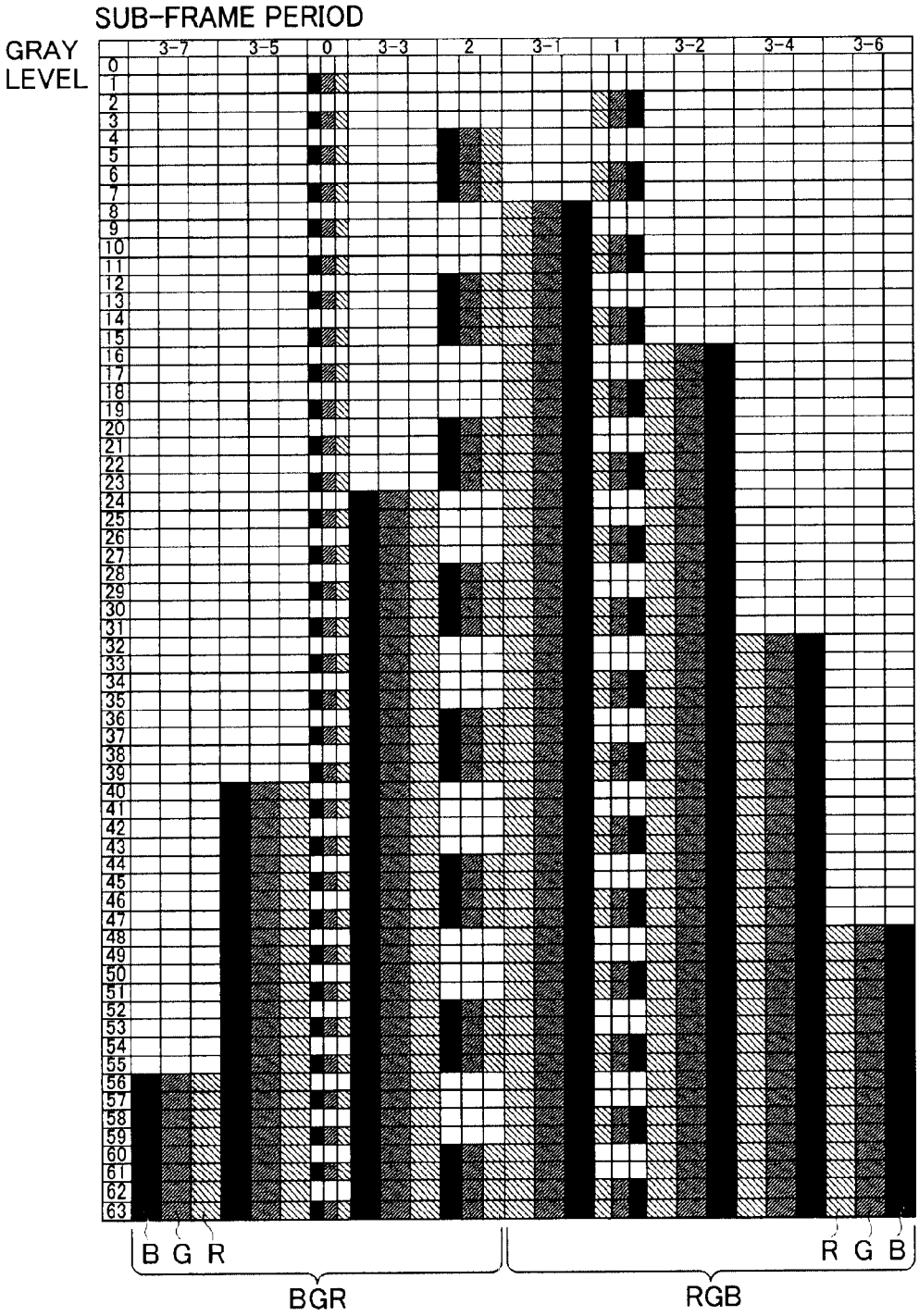
FIG. 12 is a diagram illustrating a driving sequence according to a third embodiment of the present invention.

FIG. 12 is a diagram illustrating a driving sequence according to a third embodiment of the present invention. The basic configuration and operation of a display device are virtually the same as those of the above-mentioned embodiments, and hence a difference from the above-mentioned embodiments is mainly described below.

In this embodiment, in the sub-frame periods 0, 2, 3-3, 3-5, and 3-7 that are arranged on the start point side of the one frame period, the light transmission periods are arranged in the order of B→G→R so that the light transmission period for the color B is arranged on the start point side. On the other hand, in the sub-frame periods 1, 3-1, 3-2, 3-4, and 3-6 that are arranged on the end point side of the one frame period, the light transmission periods are arranged in the order of R→G→B so that the light transmission period for the color B is arranged on the end point side. In this manner, the arrangement of colors in the light transmission periods is symmetric between the sub-frame periods 0, 2, 3-3, 3-5, and 3-7 that are arranged on the start point side of the one frame period and the sub-frame periods 1, 3-1, 3-2, 3-4, and 3-6 that are arranged on the end point side of the one frame period. The start point side of the one frame period means, for example, a start point side with respect to the emission center, and the end point side of the one frame period means, for example, an end point side with respect to the emission center.

The emission center of the sub-frame periods 0 to 2 that belong to the second group is between the sub-frame periods 2 and 1. The emission center of the sub-frame periods 3-1 to 3-7 that belong to the first group is between the sub-frame periods 3-1 and 3-3. More accurately, the emission center of the sub-frame periods 3-1 to 3-7 that belong to the first group is in the midway of the sub-frame period 3-1, but because the sub-frame periods 3-7 and 3-5 are shifted to the start point side due to the sub-frame period 0 of the second group, the emission center exists at a point slightly biased toward the start point side. In this case, the light transmission periods are arranged in the order of B→G→R in the sub-frame periods 0, 2, 3-3, 3-5, and 3-7 on the start point side with respect to the emission center and the light transmission periods are arranged in the order of R→G→B in the sub-frame periods 1, 3-1, 3-2, 3-4, and 3-6 on the end point side with respect to the emission center, so that the light transmission periods are turned on in the order of RGB from the side close to the emission center.

In the experiments conducted by the inventors of the present invention, it has been found that the sensitivity of the color breakup is lower for B than R and G. In view of this aspect, the color breakup of R can be selectively suppressed by arranging B farther away from the emission center and arranging R closer to the emission center, and as a result, the overall color breakup can be suppressed. Although the false contour of B is degraded because B is arranged farther away from the emission center, the false contour of R is suppressed because R is arranged closer to the emission center. The false contour most noticeable to the human eyes is a false contour that occurs on a face of a person, and the skin of a person is mainly constituted of R and G. Therefore, according to this embodiment, the false contour that occurs on a face of a person, which is most noticeable, can be suppressed in a focused manner.

Although not shown, in the same manner as FIGS. 4A and 4B, there may be provided a pixel A having the driving sequence of FIG. 12 and a pixel B in which arrangement of the sub-frame periods 3-1 to 3-7 that belong to the first group is opposite to that of the pixel A, and as illustrated in FIG. 5, the pixel A and the pixel B may be arranged in a checked pattern. Further, the pixel A and the pixel B may switch places for each frame period. Not that, the sub-frame periods 0 to 2 that belong to the second group are arranged at the same positions.

[Fourth Embodiment]

Figure 13:
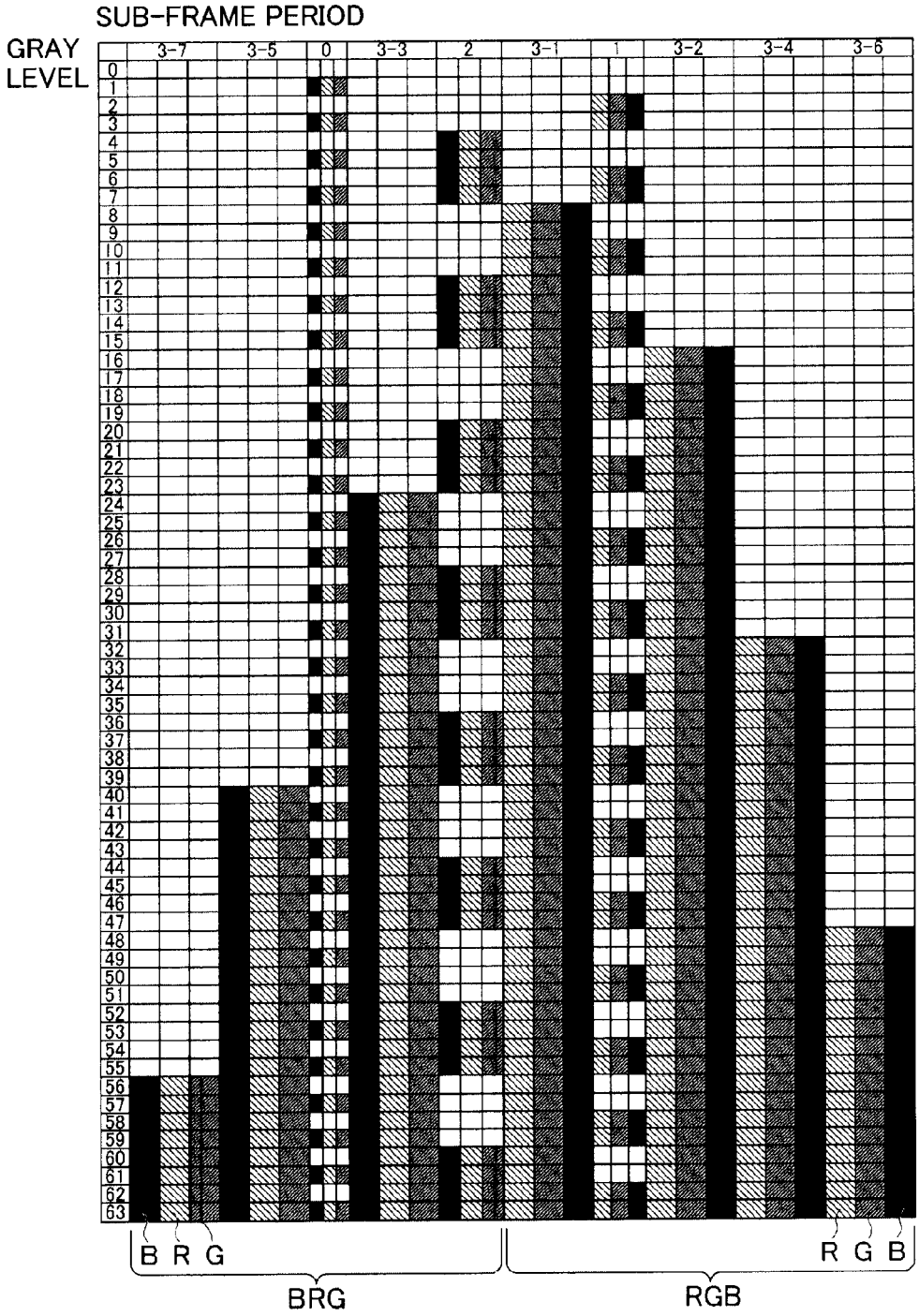
FIG. 13 is a diagram illustrating a driving sequence according to a fourth embodiment of the present invention.

FIG. 13 is a diagram illustrating a driving sequence according to a fourth embodiment of the present invention. The basic configuration and operation of a display device are virtually the same as those of the above-mentioned embodiments, and hence a difference from the above-mentioned embodiments is mainly described below.

In this embodiment, in the sub-frame periods 0, 2, 3-3, 3-5, and 3-7 that are arranged on the start point side of the one frame period, the light transmission periods are arranged in the order of B→R→G so that the light transmission period for the color B is arranged on the start point side. On the other hand, in the sub-frame periods 1, 3-1, 3-2, 3-4, and 3-6 that are arranged on the end point side of the one frame period, the light transmission periods are arranged in the order of R→G→B so that the light transmission period for the color B is arranged on the end point side. That is, in the sub-frame periods 0, 2, 3-3, 3-5, and 3-7 arranged on the start point side of the one frame period and the sub-frame periods 1, 3-1, 3-2, 3-4, and 3-6 arranged on the end point side thereof, the order of R and G is common, and only B is arranged away from the emission center.

The emission center of the sub-frame periods 0 to 2 that belong to the second group is between the sub-frame periods 2 and 1. The emission center of the sub-frame periods 3-1 to 3-7 that belong to the first group is between the sub-frame periods 3-1 and 3-3. More accurately, the emission center of the sub-frame periods 3-1 to 3-7 that belong to the first group is in the midway of the sub-frame period 3-1, but because the sub-frame periods 3-7 and 3-5 are shifted to the start point side due to the sub-frame period 0 of the second group, the emission center exists at a point slightly biased toward the start point side. In this case, the light transmission periods are arranged in the order of B→R→G in the sub-frame periods 0, 2, 3-3, 3-5, and 3-7 on the start point side with respect to the emission center and the light transmission periods are arranged in the order of R→G→B in the sub-frame periods 1, 3-1, 3-2, 3-4, and 3-6 on the end point side with respect to the emission center, so that the light transmission period for B is turned on the side farther away from the emission center.

In the experiments conducted by the inventors of the present invention, it has been found that the sensitivity of the color breakup is lower for B than R and G. In view of this aspect, the color breakup of R and G can be selectively suppressed by arranging B farther away from the emission center and arranging R closer to the emission center, and as a result, the overall color breakup can be suppressed. Although the false contour of B is degraded because B is arranged farther away from the emission center, the false contour of R and G are suppressed because R and G are arranged closer to the emission center. The false contour most noticeable to the human eyes is a false contour that occurs on a face of a person, and the skin of a person is mainly constituted of R and G. Therefore, according to this embodiment, the false contour that occurs on a face of a person, which is most noticeable, can be suppressed in a focused manner. Note that, G is dominant regarding the brightness. Therefore, the light transmission periods in the sub-frame periods of the one frame period on the start point side with respect to the emission center can be turned on in the order of BRG and the light transmission periods in the sub-frame periods of the one frame period on the end point side can be turned on in the order of GRB.

Although not shown, in the same manner as FIGS. 4A and 4B, there may be provided a pixel A having the driving sequence of FIG. 12 and a pixel B in which arrangement of the sub-frame periods 3-1 to 3-7 that belong to the first group is opposite to that of the pixel A, and as illustrated in FIG. 5, the pixel A and the pixel B may be arranged in a checked pattern. Further, the pixel A and the pixel B may switch places for each frame period. Note that, the sub-frame periods 0 to 2 that belong to the second group are arranged at the same positions.

[Fifth Embodiment]

Figure 14A:
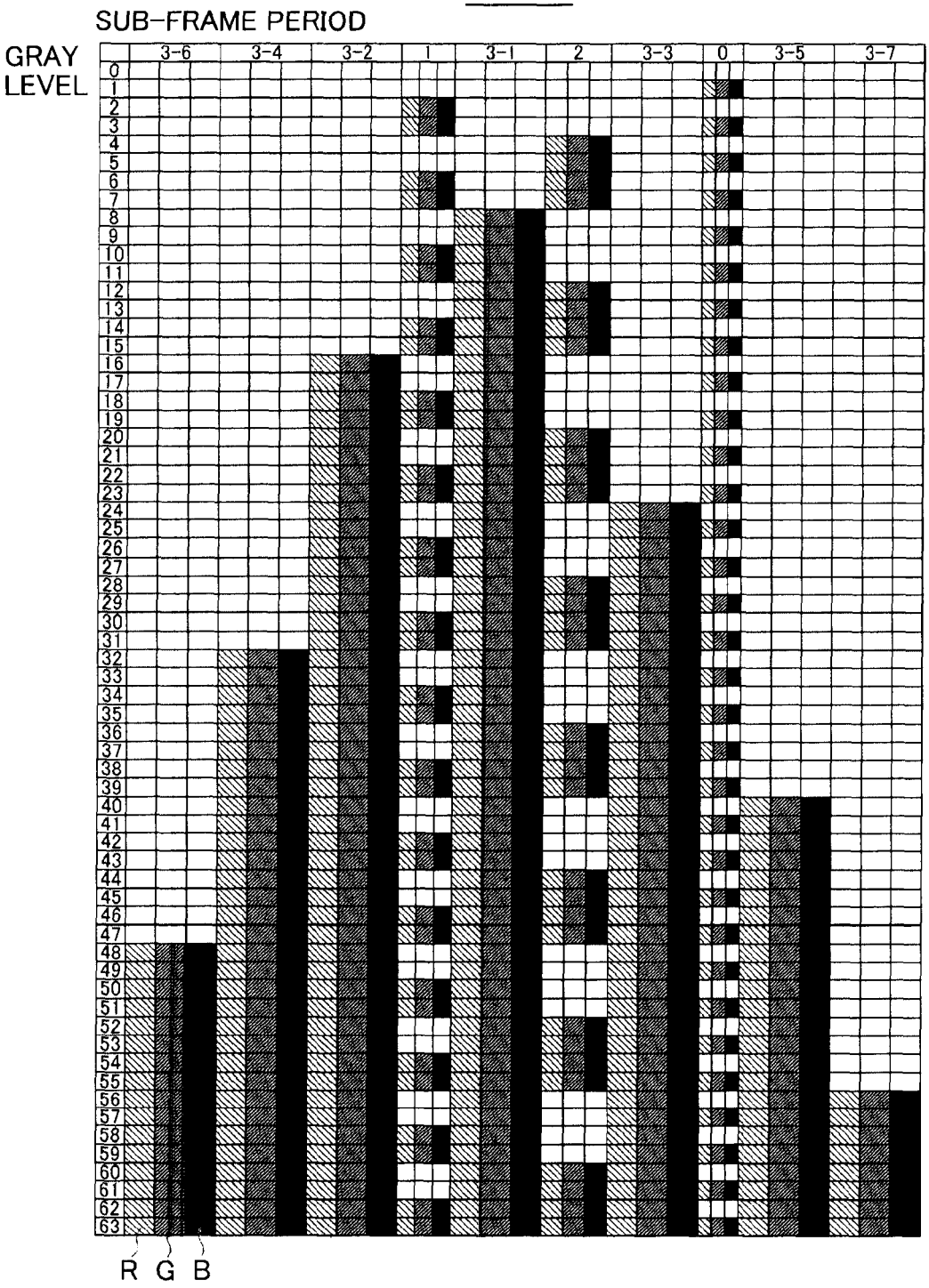
FIG. 14A is a diagram illustrating a driving sequence of a pixel A according to a fifth embodiment of the present invention.
Figure 14B:
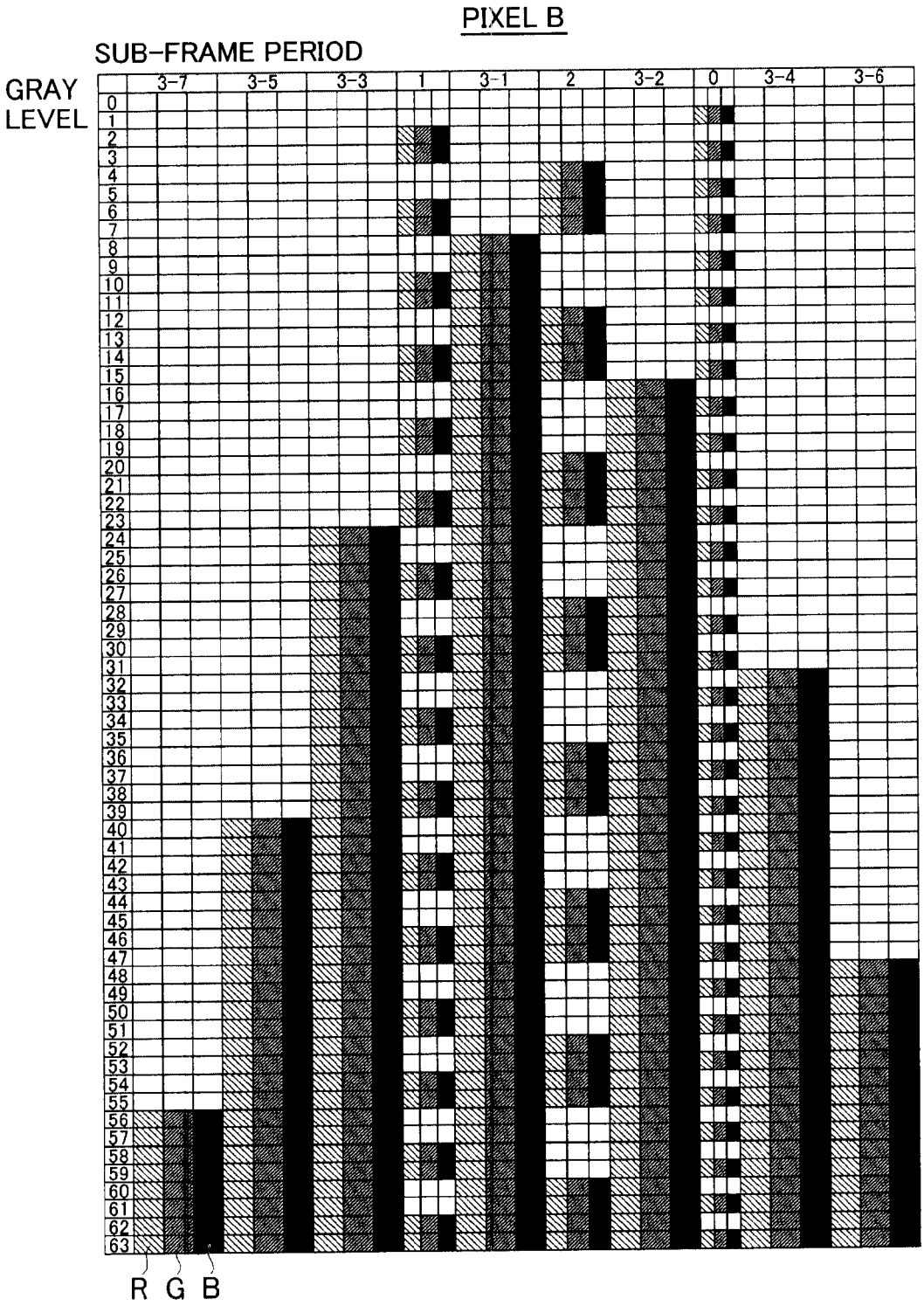
FIG. 14B is a diagram illustrating a driving sequence of a pixel B according to the fifth embodiment.

FIGS. 14A and 14B are diagrams illustrating a driving sequence in one of the frame periods according to a fifth embodiment of the present invention. The basic configuration and operation of a display device are virtually the same as those of the above-mentioned embodiments, and hence a difference from the above-mentioned embodiments is mainly described below.

In this embodiment, driving sequences of a pixel A and a pixel B are symmetrical with respect to the driving sequences of the pixel A and the pixel B shown in FIGS. 4A and 4B in a direction of time elapse in the one frame period. That is, in the pixel A shown in FIG. 14A, all the sub-frame periods 3-1 to 3-7 that belong to the first group and all the sub-frame periods 0 to 2 that belong to the second group are arranged in a symmetrical manner with respect to the pixel A shown in FIG. 4A. In the same manner, in the pixel B shown in FIG. 14B, all the sub-frame periods 3-1 to 3-7 that belong to the first group and all the sub-frame periods 0 to 2 that belong to the second group are arranged in a symmetrical manner with respect to the pixel B shown in FIG. 4B. Further, in the pixel A and the pixel B, only the sub-frame periods 3-1 to 3-7 that belong to the first group are arranged in a symmetrical manner in the direction of time elapse in the one frame period, in the same manner as the relation between FIGS. 4A and 4B.

A turn-on sequence of the sub-frame periods 0 to 2 that belong to the second group of the pixel A and the pixel B is different from that in FIGS. 4A and 4B, and is the order of sub-frame periods 1, 2, and 0. Further, the turn-on positions of the sub-frame periods 0 to 2 that belong to the second group of the pixel A and the pixel B are shifted by one of the sub-frame periods 3-1 to 3-7 that belong to the first group with respect to the case of FIGS. 4A and 4B. If the sub-frame periods 0 and 1 are simply switched, a time interval between the emission center of the first group and the emission center of the second group increases. To cope with this problem, the turn-on positions of the sub-frame periods 0 to 2 that belong to the second group are shifted by one of the sub-frame periods 3-1 to 3-7 that belong to the first group so as to avoid a degradation of the false contour that occurs at the lowest gray levels that are shifted when the sub-frame period is changed from the sub-frame period of the second group to the sub-frame period of the first group (from gray level 7 to gray level 8).

In this embodiment, a driving sequence in one of the frame periods of the pixel A and the pixel B configured in the above-mentioned manner and a driving sequence in the other of the frame periods of the pixel A and the pixel B shown in FIGS. 4A and 4B are executed in an alternate manner.

Figure 15A:
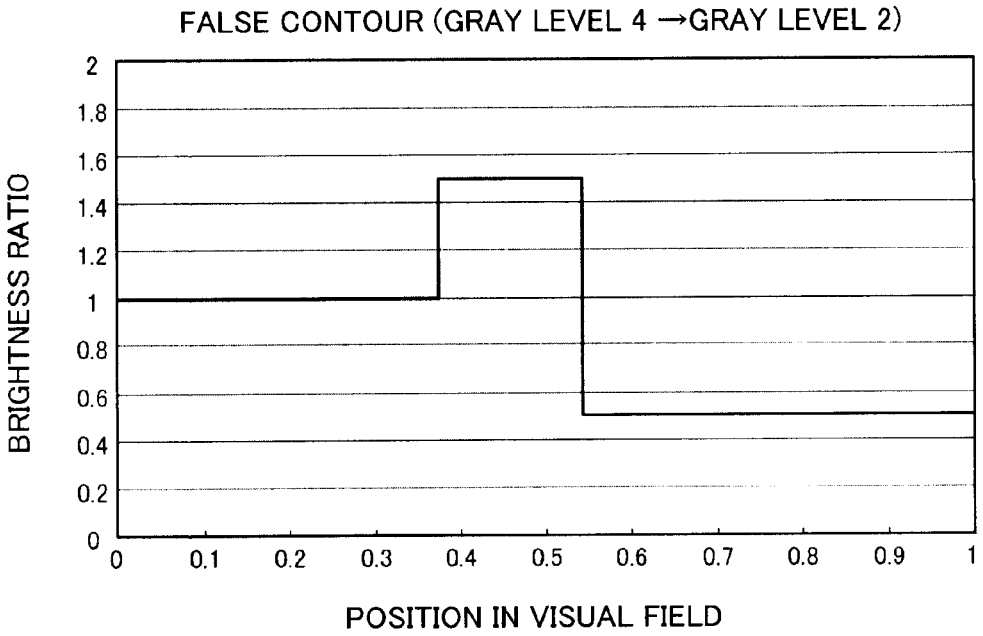
FIGS. 15A to 15C are graphs showing simulation results of simulating false contours in different conditions.
Figure 15B:
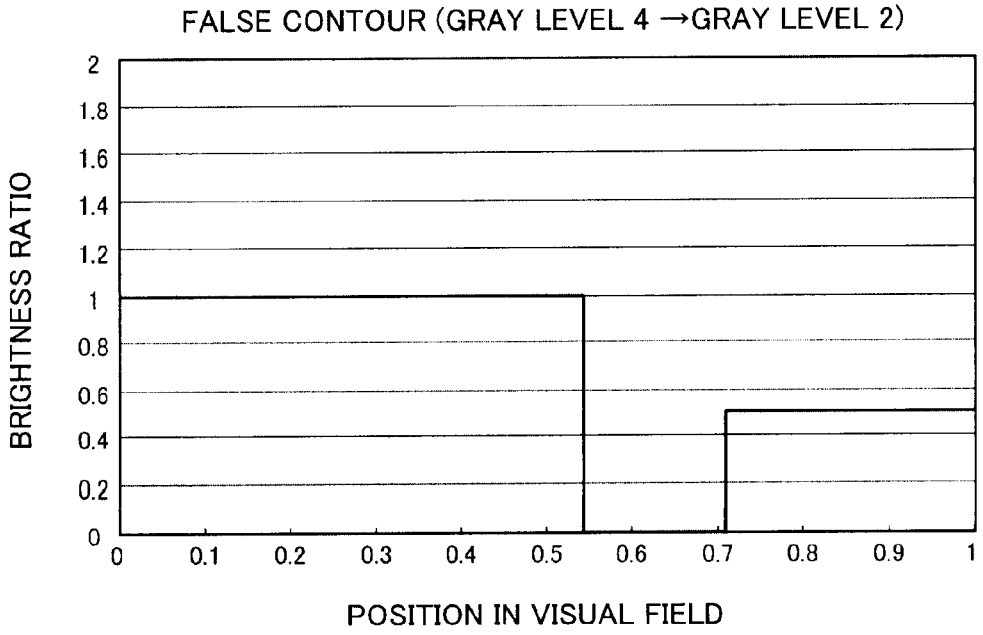
Figure 15C:
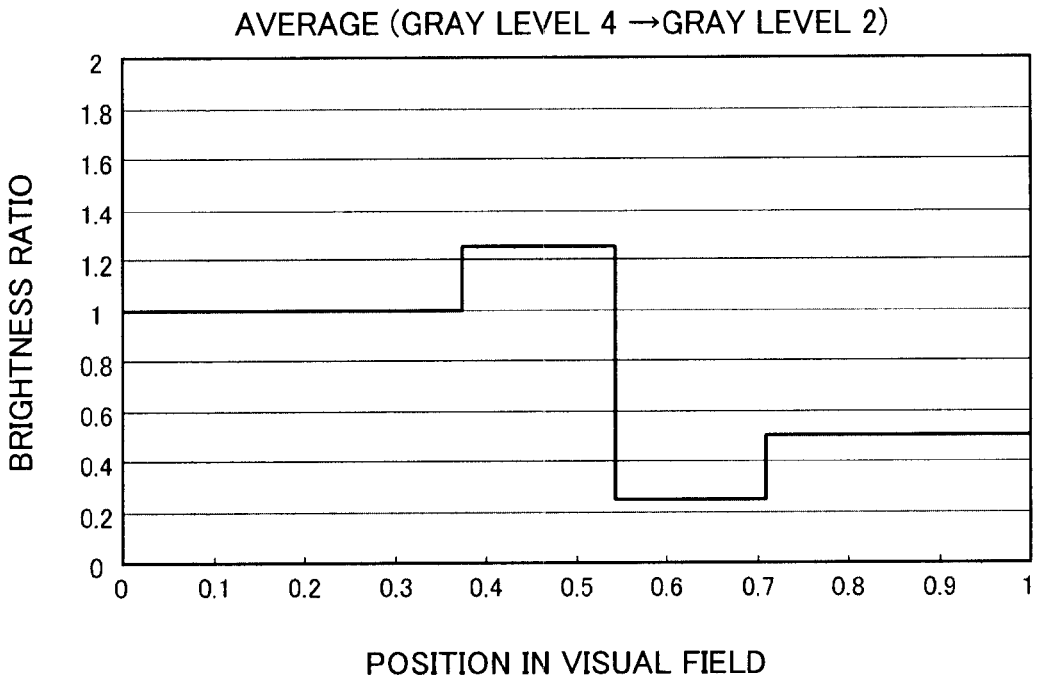

FIGS. 15A to 15C are graphs showing simulation results of simulating false contours in different conditions. FIG. 15A is a graph showing a result of a false contour simulation when making a transition from gray level 4 of FIG. 4A to gray level 2 of FIG. 4B, and FIG. 15B is a graph showing a result of a false contour simulation when making a transition from gray level 4 of FIG. 14A to gray level 2 of FIG. 14B. A false contour brighter than gray level 4 occurs in FIG. 15A, and a darker false contour occurs in FIG. 15B. FIG. 15A and FIG. 15B switch places for each frame period, and hence an average shown in FIG. 15C is recognized by the human eyes.

In this manner, by combining a method of switching the turn-on sequence of the sub-frame periods 0 to 2 that belong to the second group for each frame period, the false contour and the color breakup in the sub-frame periods 0 to 2 that belong to the second group can be suppressed, leaving the false contour and the color breakup in the sub-frame periods 3-1 to 3-7 that belong to the first group as they are.

However, in this driving sequence, the positions of the sub-frame periods 0 and 1 switch places for each frame period, and hence the sub-frame periods 0 (or 1) in two frame periods may become temporally close to each other or far from each other, and therefore, it is presumed to be a flicker. According to the experiments conducted by the inventors of the present invention, the flicker is hard to be recognized in a low brightness condition, and hence the flicker is hard to be recognized at the time of a low bit display (in this case, the sub-frame periods 0 and 1). When the sub-frame periods 3-1 to 3-7 that belong to the first group and the sub-frame periods 0 to 2 that belong to the second group are in emission at the same time, the sub-frame periods 3-1 to 3-7 that belong to the first group in which the brightness is higher becomes dominant, and therefore, the flicker is hard to be recognized.

In this manner, the fact that the flicker is hard to be recognized in a low brightness condition can be utilized in a positive manner by switching the turn-on sequence of the sub-frame periods 0 to 2 that belong to the second group for each frame period, and as a result, the false contour and the color breakup that occur in the sub-frame periods 0 to 2 that belong to the second group can be suppressed.

[Sixth Embodiment]

Figure 16:
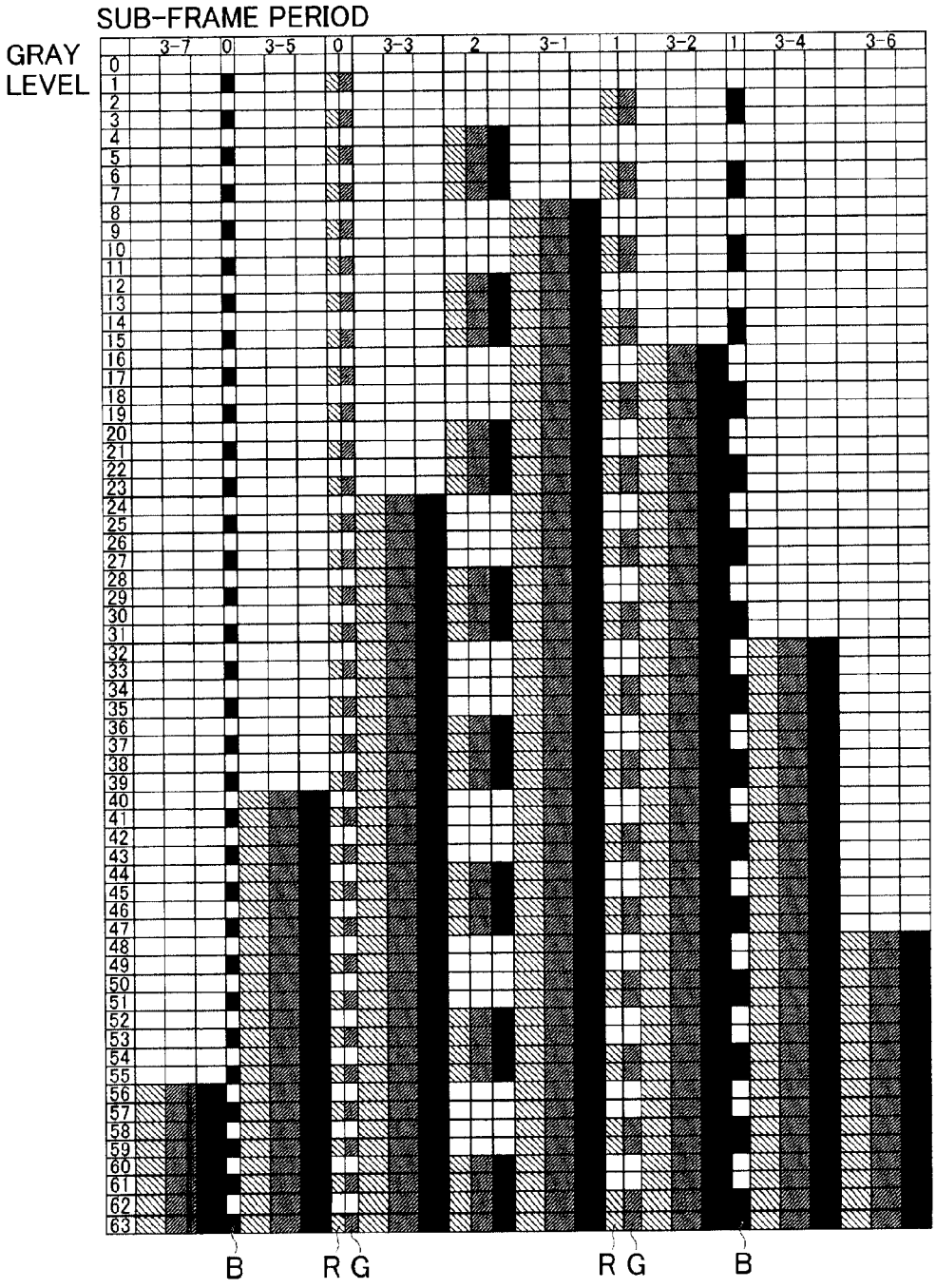
FIG. 16 is a diagram illustrating a driving sequence according to a sixth embodiment of the present invention.

FIG. 16 is a diagram illustrating a driving sequence according to a sixth embodiment of the present invention. The basic configuration and operation of a display device are virtually the same as those of the above-mentioned embodiments, and hence a difference from the above-mentioned embodiments is mainly described below.

In this embodiment, the light transmission period of B is arranged toward the start point side while being separated from the light transmission periods of R and G in the sub-frame period 0 of the second group arranged on the start point side of one frame period, and the sub-frame period 3-5 that belongs to the first group is arranged between the light transmission period of B and the light transmission periods of R and G. On the other hand, in the sub-frame period 1 that belongs to the second group arranged on the end point side of the one frame period, the light transmission period of B is arranged toward the end point side while being separated from the light transmission periods of R and G, and the sub-frame period 3-2 that belongs to the first group is arranged between the light transmission period of B and the light transmission periods of R and G. The number of sub-frame periods that belong to the first group to be arranged between the light transmission period of B and the light transmission periods of R and G may be equal to or larger than 2.

In other words, the light transmission periods of R and G of the sub-frame period 0 that belongs to the second group are arranged between the sub-frame periods 3-5 and 3-3 that belong to the first group, and the light transmission period of B is arranged between the sub-frame periods 3-7 and 3-5 that belong to the first group. Further, the light transmission periods of R and G of the sub-frame period 1 that belongs to the second group are arranged between the sub-frame periods 3-1 and 3-2 that belong to the first group, and the light transmission period of B is arranged between the sub-frame periods 3-2 and 3-4 that belong to the first group.

If an emission pitch is different in the sub-frame periods 3-1 to 3-7 that belong to the first group, a problem similar to an overlapped image (ghost) occurs when displaying a movie. The sensitivity of B on the false contour and the color breakup is low compared to R and G, and hence, as in this embodiment, the occurrence of the ghost can be suppressed by shifting only B of the sub-frame periods 0 and 1 that belong to the second group in a direction away from the center of the one frame period and thus shifting the emission pitch of the sub-frame periods 3-1 to 3-7 that belong to the first group in a stepwise manner.

In this embodiment, the sub-frame period 3-5 that belongs to the first group is brought closer to the emission center because the light transmission period of B of the sub-frame period 0 that belongs to the second group is shifted toward the start point side of the one frame period, and the sub-frame period 3-2 that belongs to the first group is brought closer to the emission center because the light transmission period of B of the sub-frame period 1 that belongs to the second group is shifted toward the end point side of the one frame period. Therefore, the false contour and the color breakup with respect to the sub-frame periods 3-5 and 3-2 that belong to the first group are suppressed. On the contrary, regarding the second group, the false contour and the color breakup are degraded because the light transmission periods of B of the sub-frame periods 0 and 1 are separated from the light transmission periods of R and G in the direction away from the emission center. However, the sub-frame periods 0 and 1 have a low bit and are limited to the color having low color breakup sensitivity, and hence the degree of degradation of the false contour and the color breakup is suppressed to a small amount.

Although not shown, in the same manner as FIGS. 4A and 4B, there may be provided a pixel A having the driving sequence of FIG. 16 and a pixel B in which arrangement of the sub-frame periods 3-1 to 3-7 that belong to the first group is opposite to that of the pixel A, and as illustrated in FIG. 5, the pixel A and the pixel B may be arranged in a checked pattern. Further, the pixel A and the pixel B may switch places for each frame period. Note that, the sub-frame periods 0 to 2 that belong to the second group are arranged at the same positions.

[Seventh Embodiment]

Figure 17:
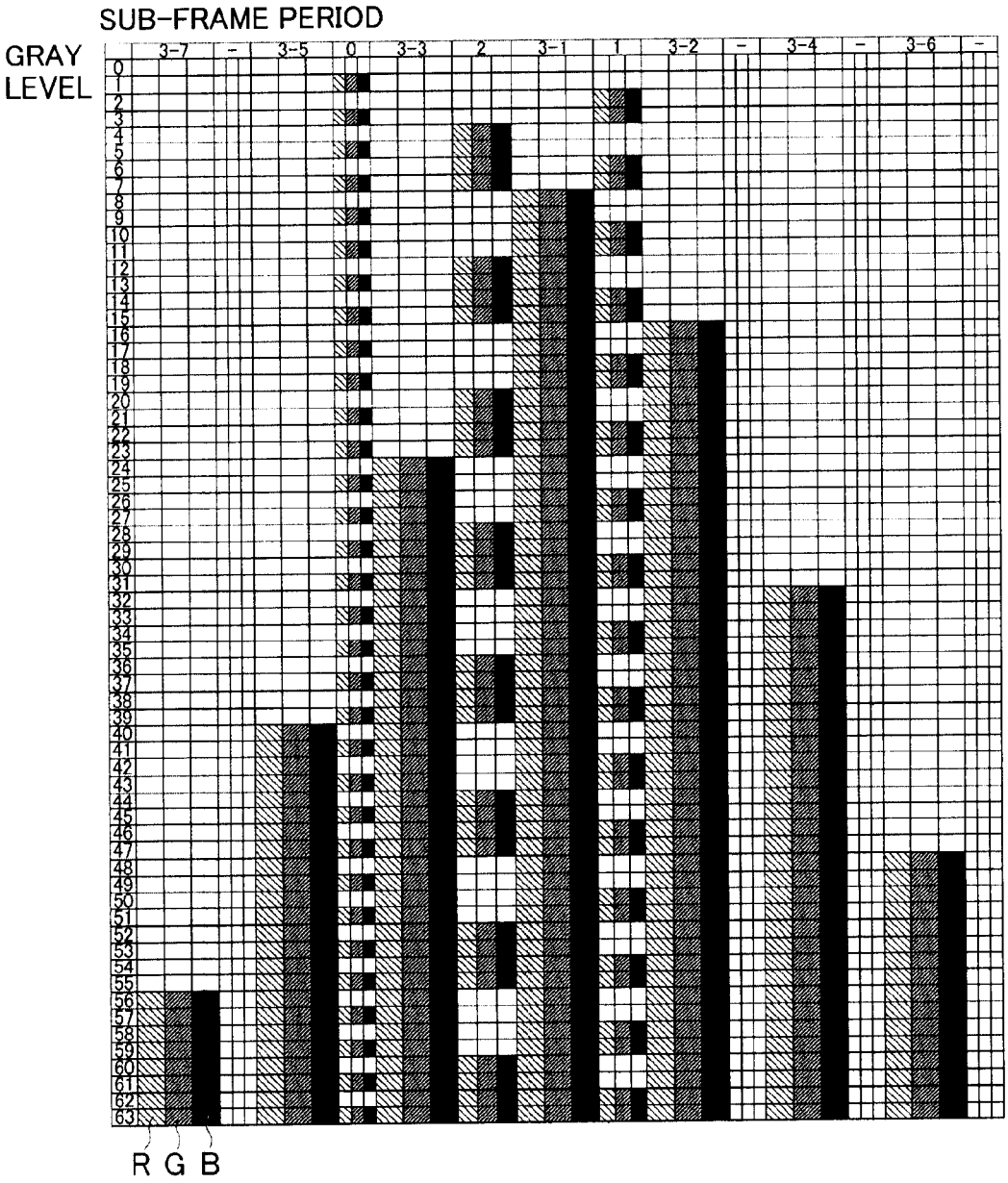
FIG. 17 is a diagram illustrating a driving sequence according to a seventh embodiment of the present invention.

FIG. 17 is a diagram illustrating a driving sequence according to a seventh embodiment of the present invention. The basic configuration and operation of a display device are virtually the same as those of the above-mentioned embodiments, and hence a difference from the above-mentioned embodiments is mainly described below.

In this embodiment, the sub-frame periods 0 to 2 that belong to the first group or a blank period is arranged between every adjacent two of the sub-frame periods 3-1 to 3-7 that belong to the first group. That is, between adjacent two of the sub-frame periods 3-1 to 3-7 that belong to the first group, a dummy sub-frame period that does not contribute to the emission is arranged between adjacent two of the sub-frame periods 3-1 to 3-7 in which the sub-frame periods 0 to 2 that belong to the second group are not arranged. A length of the dummy sub-frame period is, for example, equal to or smaller than 50% of an average of pitches of the sub-frame periods 3-1 to 3-7 that belong to the first group. With this arrangement, the ghost can be suppressed.

[Eighth Embodiment]

Figure 18:
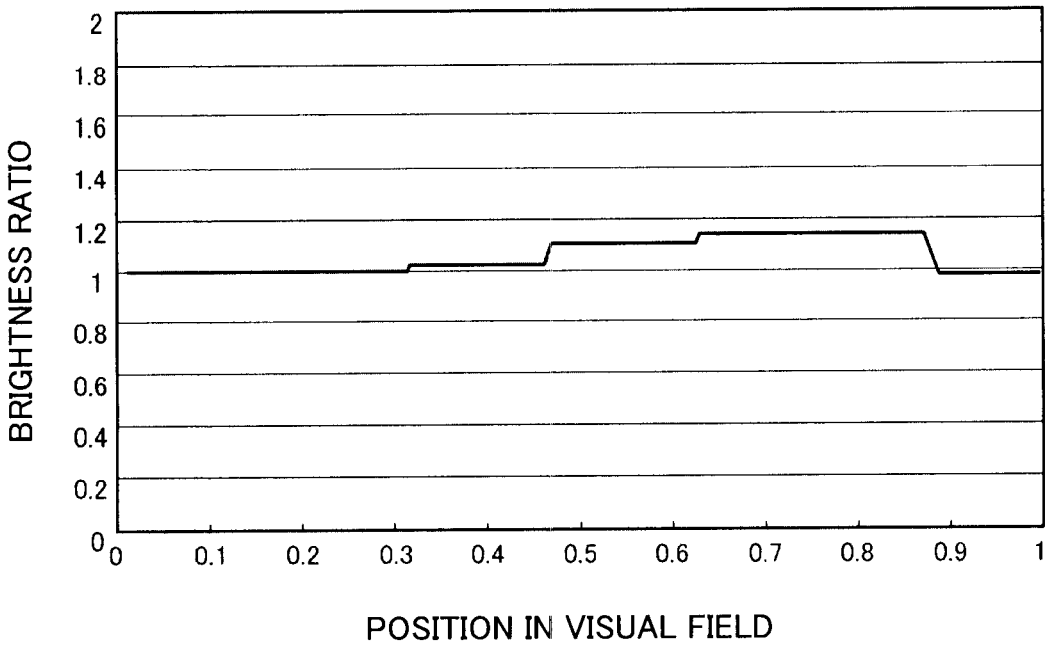
FIG. 18 is a graph showing a simulation result of simulating a false contour.

Before describing an eighth embodiment of the present invention, a result of simulating the false contour shown in FIG. 18 is described. The graph of FIG. 18 shows a false contour simulation result when making a transition from gray level 48 of FIG. 4B to gray level 47 of FIG. 4A. In the graph of FIG. 18, although the change of the brightness ratio is small, a false contour occurs across a broad range from about 0.31 to about 0.87 of the position in the visual field. Through evaluation with an actual visual contact, this false contour is recognized. The reason why the false contour is broadened is because the gray level reaches a multiple of 8, and when the sub-frame period is changed from the sub-frame period that belongs to the second group to the sub-frame period that belongs to the first group, a sub-frame period, in which a light transmission period newly appears, appears at an edge of the start point side or the end point side of one frame period of a set of the sub-frame periods having the light transmission period. Therefore, as in the eighth embodiment described below, at a gray level other than the gray level for which the sub-frame period is changed from the sub-frame period that belongs to the second group to the sub-frame period that belongs to the first group, the position of the sub-frame period having the light transmission period is shifted in the first group (hereinafter, referred to as "cell feed").

Figure 19:
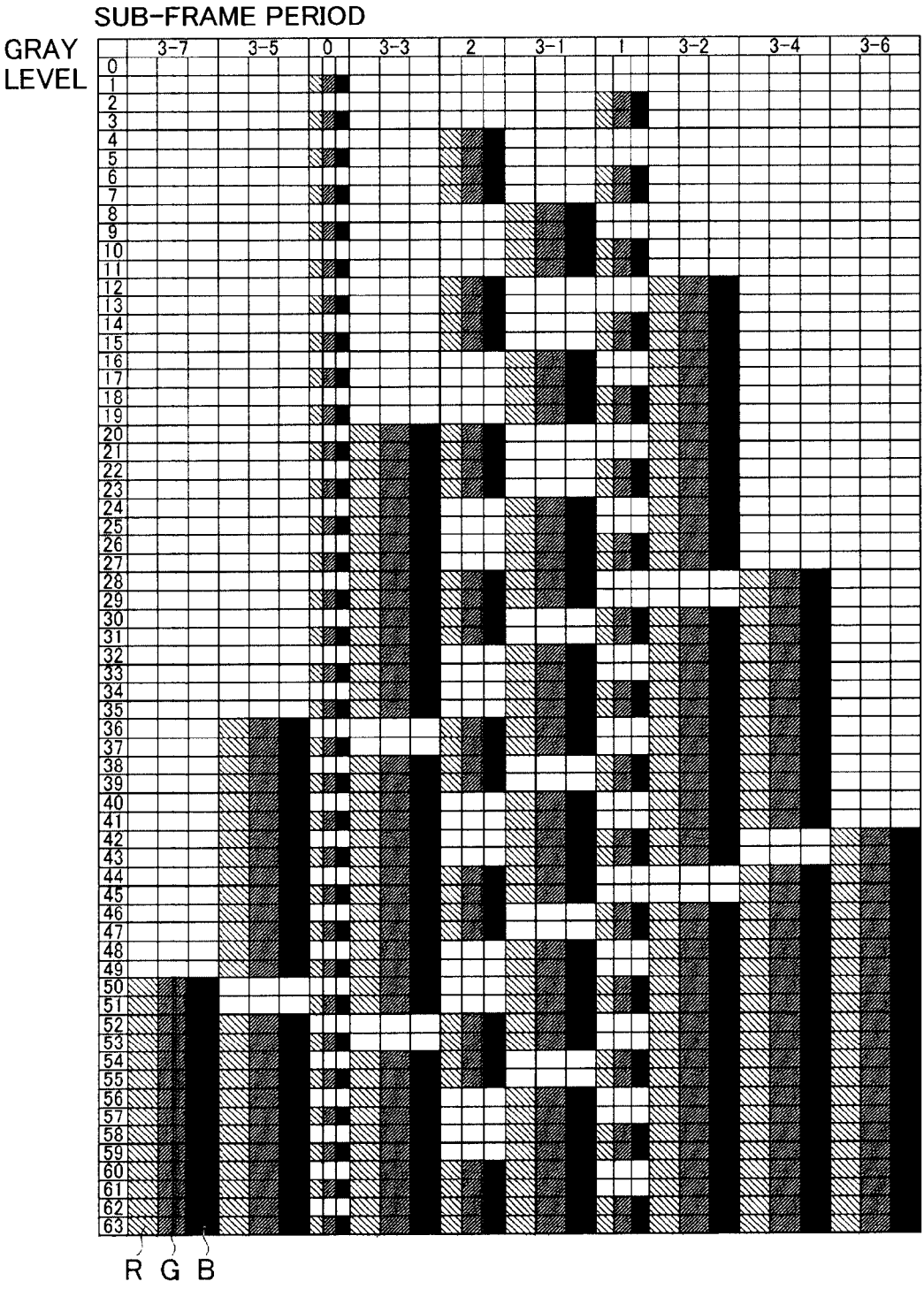
FIG. 19 is a diagram illustrating a driving sequence according to an eighth embodiment of the present invention.

FIG. 19 is a diagram illustrating a driving sequence according to the eighth embodiment of the present invention. The basic configuration and operation of a display device are virtually the same as those of the above-mentioned embodiments, and hence a difference from the above-mentioned embodiments is mainly described below.

This embodiment is an example in which the cell feed is applied to the first embodiment shown in FIGS. 4A and 4B. That is, at a gray level before the number of the sub-frame periods having the light transmission period that belong to the first group increases, a sub-frame period having the light transmission period that belongs to the first group is moved to the next sub-frame period that belongs to the first group. Specifically, at a gray level before the gray level increases from gray level 15 to gray level 16 at which the sub-frame period is changed from the second group to the first group (from gray level 11 to gray level 12), the light transmission period is shifted from the sub-frame period 3-1 to the sub-frame period 3-2 of the first group. With this arrangement, the sub-frame period in which the existence of the light transmission period is changed the next time the sub-frame period is changed between the groups becomes the sub-frame period 3-1 that is located at the center. The cell feed is performed in the same manner at a higher gray level. When the position change of the light transmission period at the time when the sub-frame period is changed between the groups is more than two sub-frame periods, the cell feed can be performed a plurality of times. This enables a width of the false contour in the visual field to approach a constant value at every moment, and as a result, a broad false contour can be divided into a plurality of gray levels to make the false contour less noticeable. The timing for performing the cell feed can be adjusted to the change of the sub-frame period of the second group, and to the change of the sub-frame period of the second group with a bit length as long as possible. For example, from gray level 8 to gray level 24, one cell feed is required to the sub-frame period 3-2 or the sub-frame period 3-3, and in this case, the cell feed is performed at the timing of changing the sub-frame period to the sub-frame period 2. After gray level 24, two to three times of the cell feed is required, and in this case, the cell feeds are performed at the timing of changing the sub-frame period to the sub-frame period 1. With this operation, an effect is obtained in which a false contour caused by the cell feed and a false contour caused by the change of the sub-frame period of the second group are canceled with each other (a change of brightness of the false contour is reduced).

Although the sub-frame period for changing the group from the second group to the first group is only the sub-frame period 3-1 that is located at the center in this embodiment, the change can be performed to the sub-frame period 3-2 or 3-3. A false contour occurs due to the cell feed, and hence the number of gray levels at which the false contour occurs increases as the number of the cell feeds increases. If the change of the group from the second group is performed only at the sub-frame period 3-1 as in this embodiment, the number of the cell feeds is 12. However, if the change of the group from the second group is performed at the sub-frame period 3-2 or 3-3, the number of the cell feeds is six. Both methods can be used depending on the resolution of a display panel.

[Ninth Embodiment]

Figure 20A:
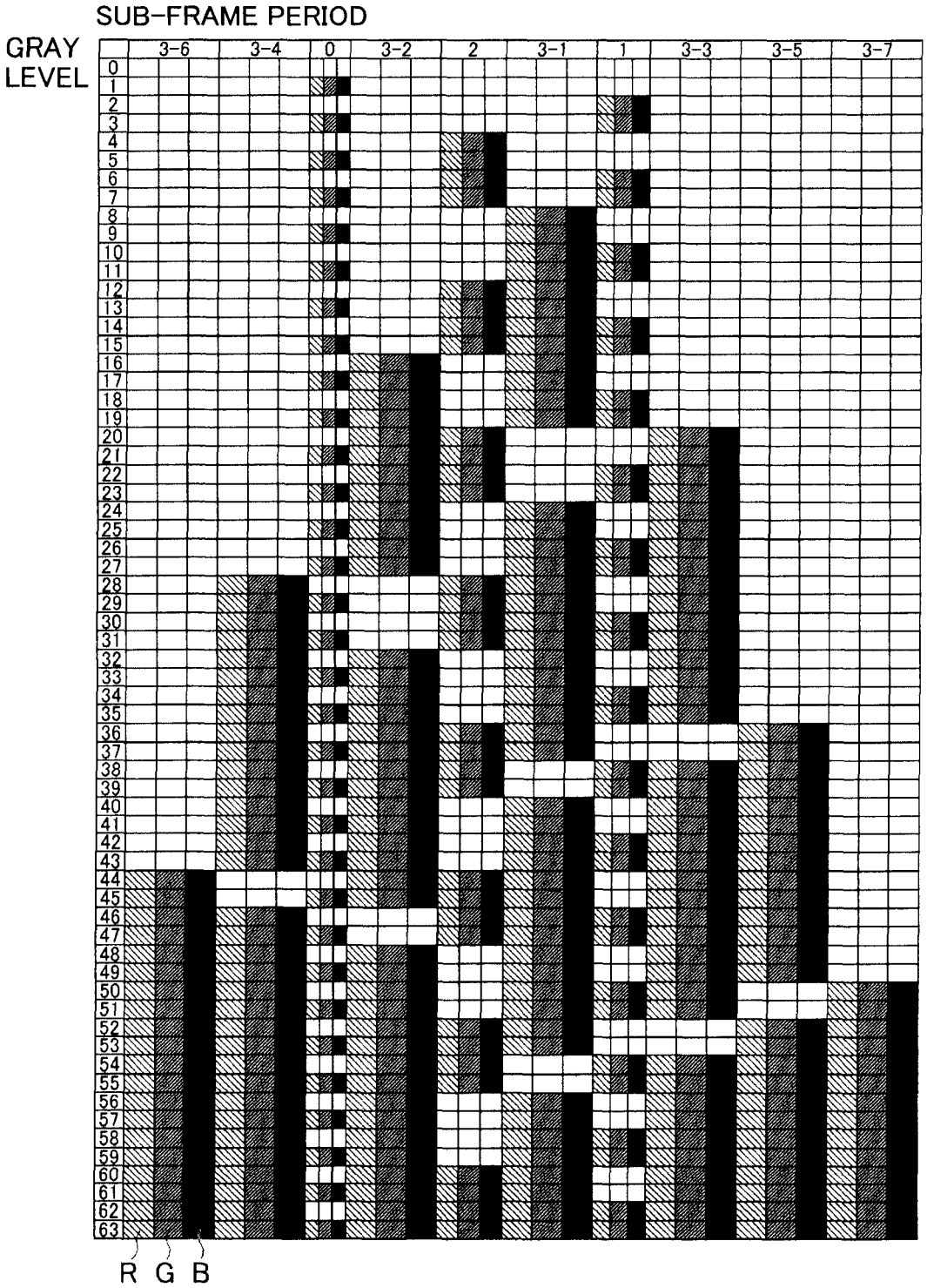
FIG. 20A is a diagram illustrating a driving sequence of a pixel A according to a ninth embodiment of the present invention.
Figure 20B:
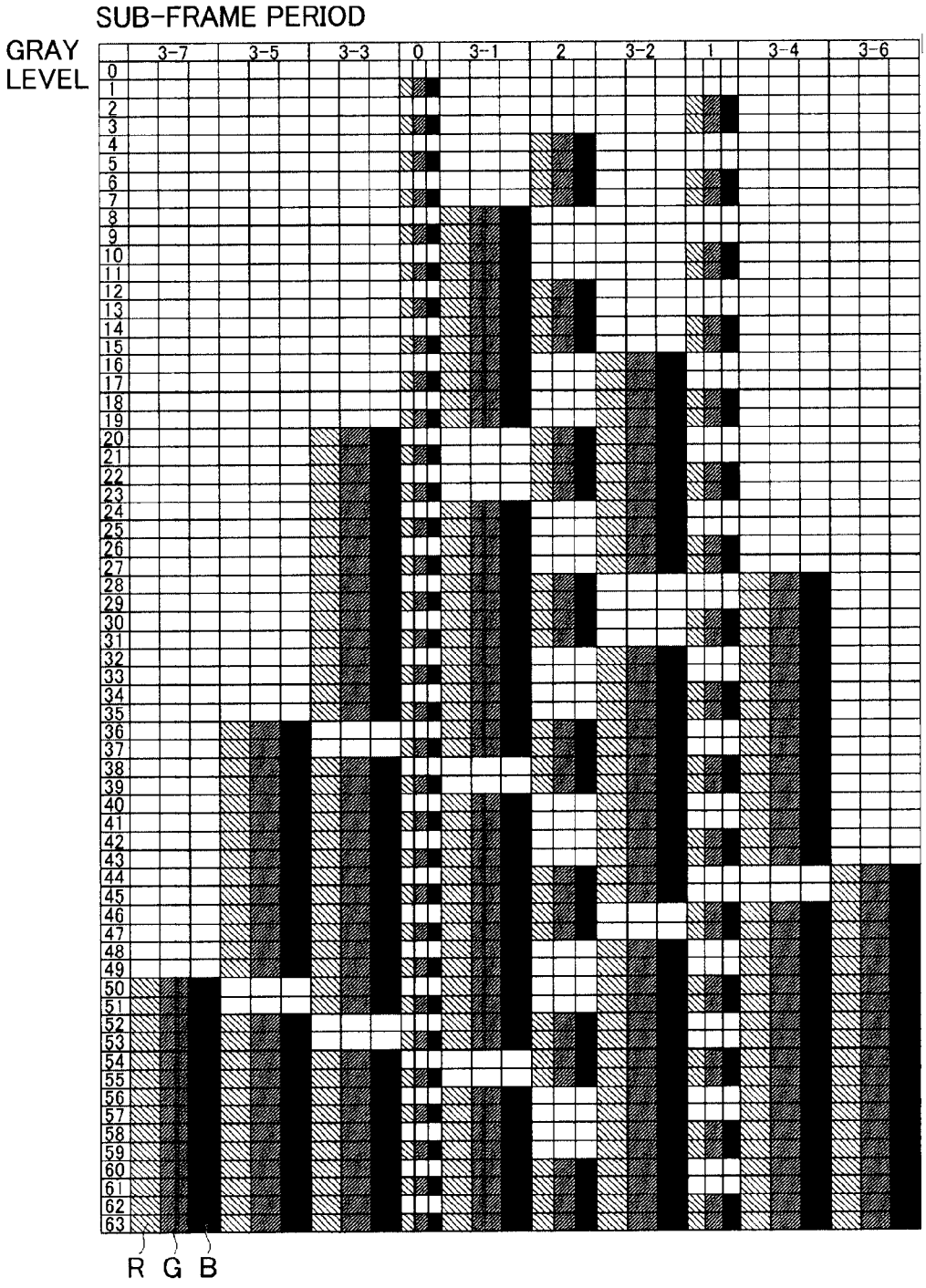
FIG. 20B is a diagram illustrating a driving sequence of a pixel B according to the ninth embodiment.

FIGS. 20A and 20B are diagrams illustrating a driving sequence according to a ninth embodiment of the present invention. The basic configuration and operation of a display device are virtually the same as those of the above-mentioned embodiments, and hence a difference from the above-mentioned embodiments is mainly described below.

In this embodiment, the change of the group from the second group is performed at the sub-frame periods 3-1 and 3-2 that belong to the first group arranged before and after the sub-frame period 2 having the longest bit length among the sub-frame periods 0 to 2 that belong to the second group. In a pixel A of FIG. 20A, when the light transmission period appears in the odd-numbered sub-frame periods 3-3, 3-5, and 3-7 arranged on the end point side of one frame period among the sub-frame periods 3-1 to 3-7 that belong to the first group, the change of the group from the second group is performed at the sub-frame period 3-1 that is close to those sub-frame periods. On the other hand, when the light transmission appears in the even-numbered sub-frame periods 3-2, 3-4, and 3-6 arranged on the start point side of the one frame period, the change of the group from the second group is performed at the sub-frame period 3-2 that is close to those sub-frame periods.

On the other hand, in a pixel B of FIG. 20B, when the light transmission period appears in the odd-numbered sub-frame periods 3-3, 3-5, and 3-7 arranged on the start point side of one frame period among the sub-frame periods 3-1 to 3-7 that belong to the first group, the change of the group from the second group is performed at the sub-frame period 3-1 that is close to those sub-frame periods. On the other hand, when the light transmission period appears in the even-numbered sub-frame periods 3-2, 3-4, and 3-6 arranged on the end point side of the one frame period, the change of the group from the second group is performed at the sub-frame period 3-2 that is close to those sub-frame periods. In the pixel B of FIG. 20B, a distance between the emission center of the first group and the emission center of the second group is larger than that in the pixel A of FIG. 20A.

In the pixel A and the pixel B of FIGS. 20A and 20B, the positions of the sub-frame periods 0 to 2 that belong to the second group are shifted with respect to the sub-frame periods 3-1 to 3-7 that belong to the first group. That is, in the pixel A, two sub-frame periods 3-6 and 3-4 are arranged on the start point side with respect to the sub-frame period 0, while three sub-frame periods 3-7, 3-5, and 3-3 are arranged on the start point side with respect to the sub-frame period 0 in the pixel B. With this arrangement, the sub-frame periods 0 to 2 of the pixel A and the pixel B cannot be turned on at the common timing.

Figure 21:
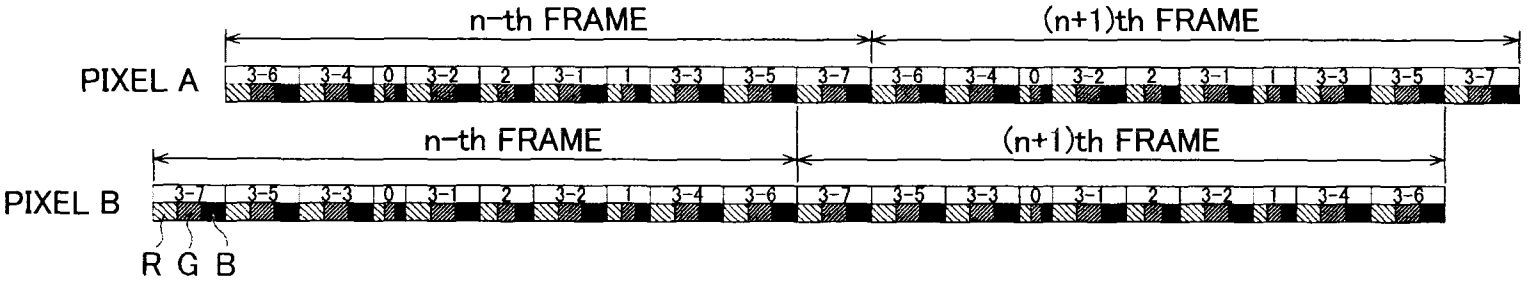
FIG. 21 is a diagram illustrating an overlap of frame periods.
Figure 22:
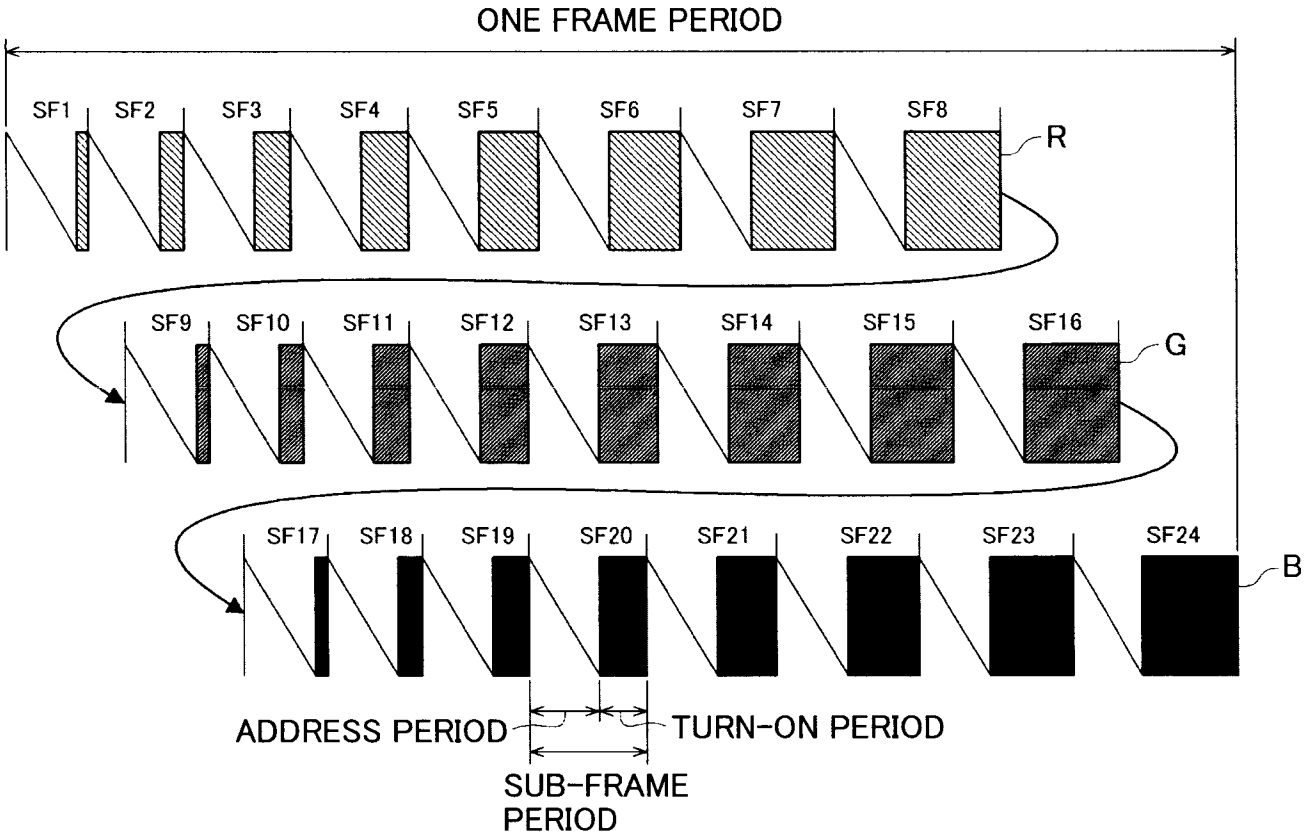
FIG. 22 is a diagram illustrating a turn-on period of a light source in a first referential example.
Figure 23:
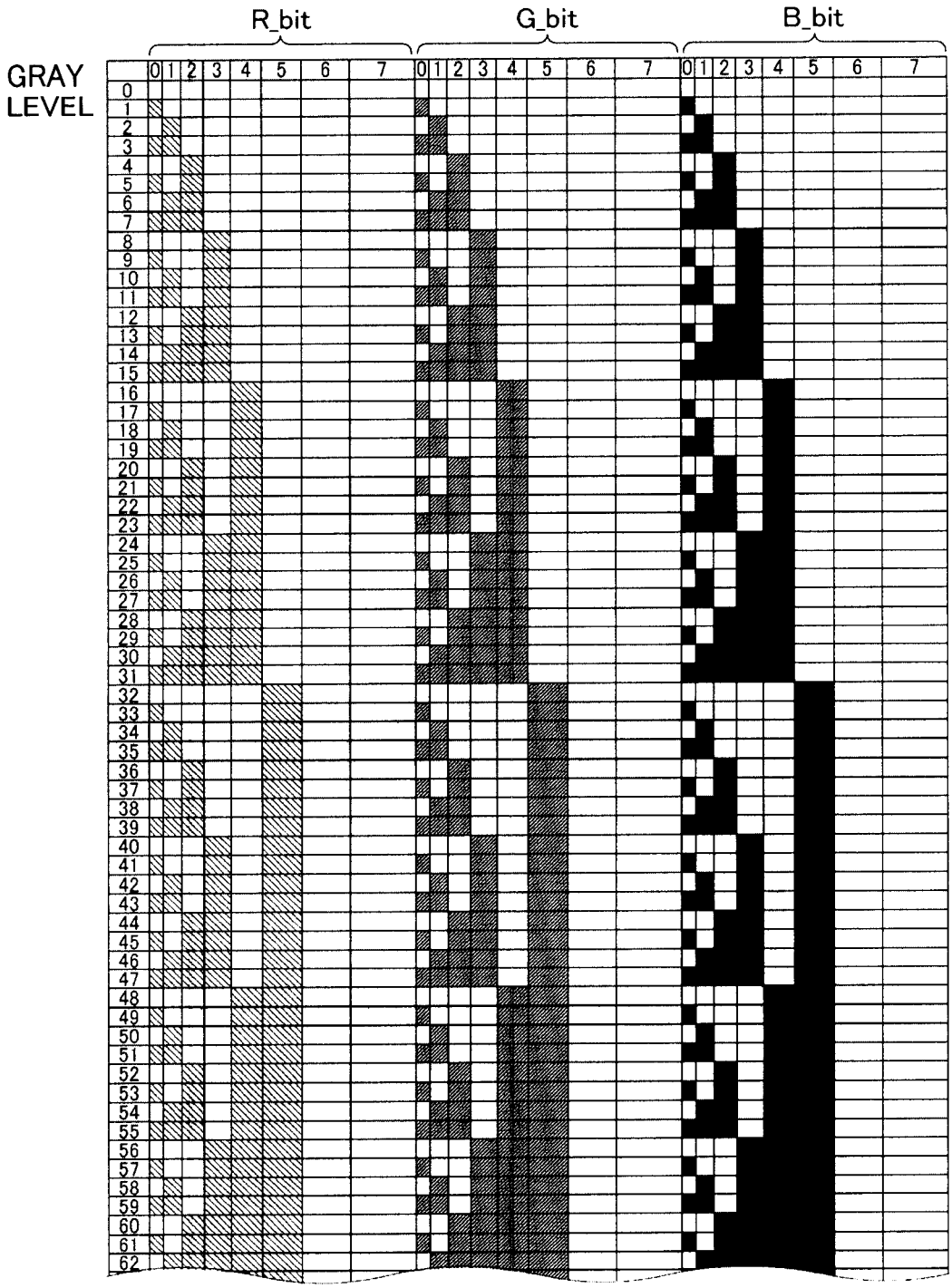
FIG. 23 is a diagram illustrating a light transmission period in the first referential example.
Figure 24:
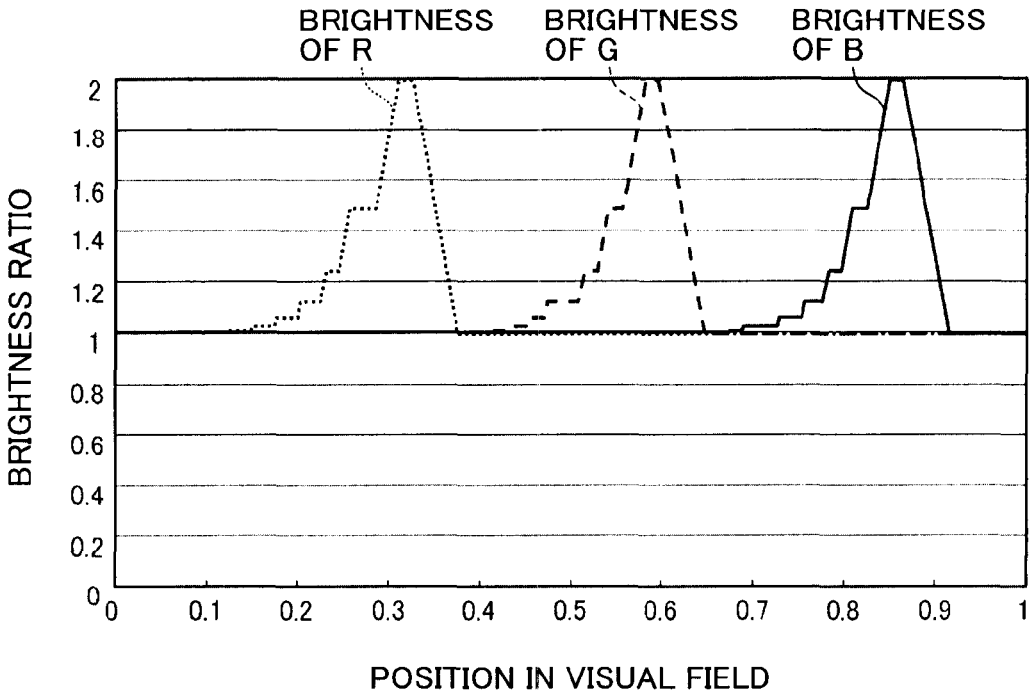
FIG. 24 is a graph showing an occurrence of a false contour.
Figure 25A:
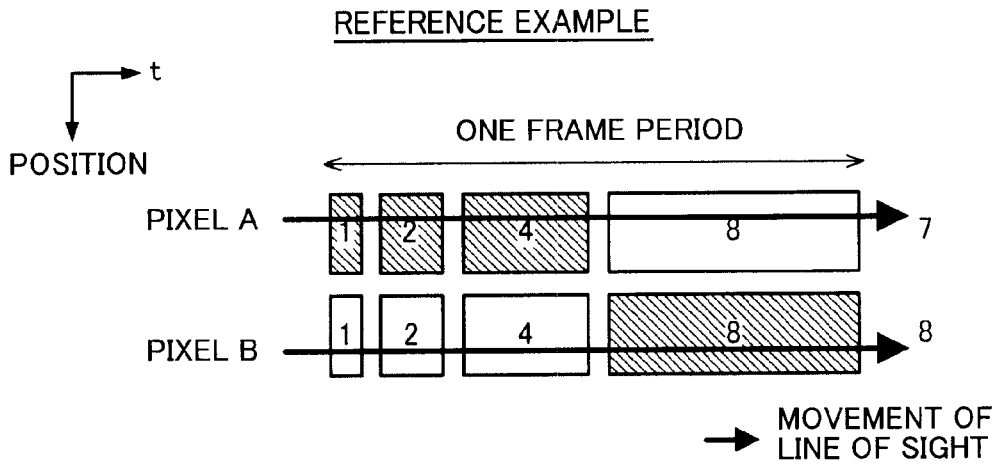
FIGS. 25A and 25B are diagrams illustrating a principle of the false counter occurrence.
Figure 25B:
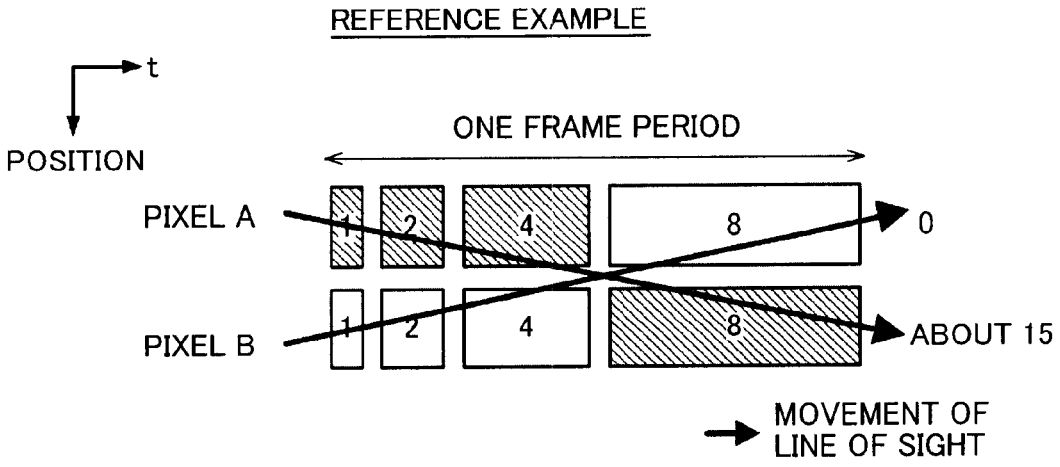
Figure 26A:
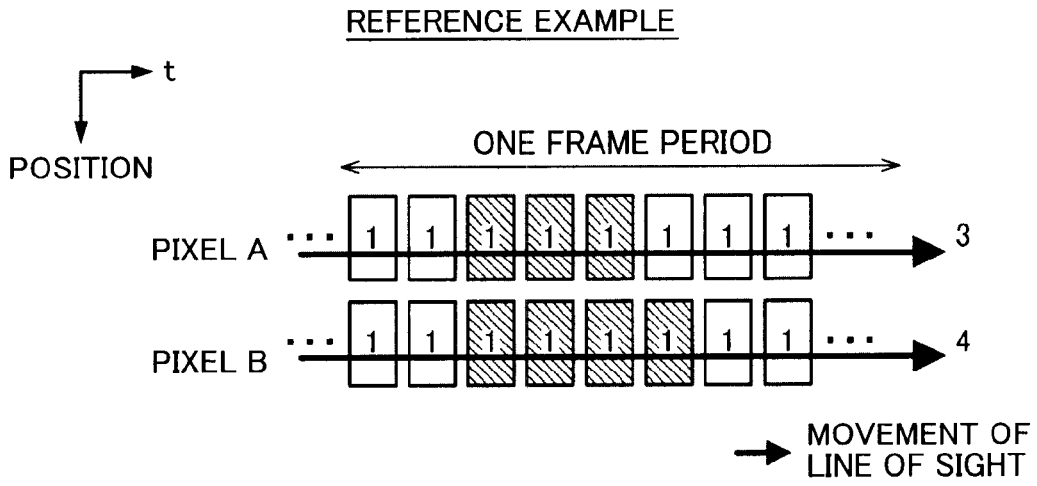
FIGS. 26A and 26B are diagrams illustrating a suppression of the false contour.
Figure 26B:
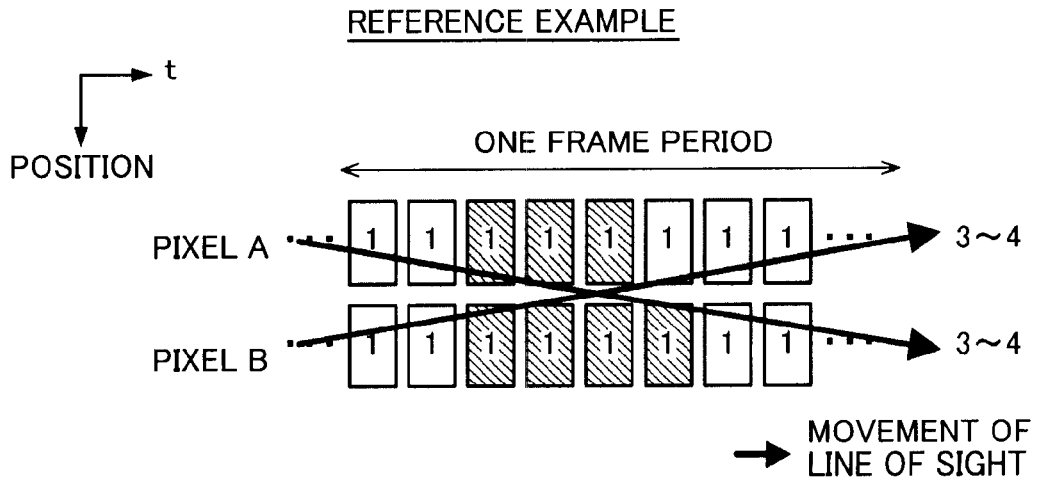
Figure 27:
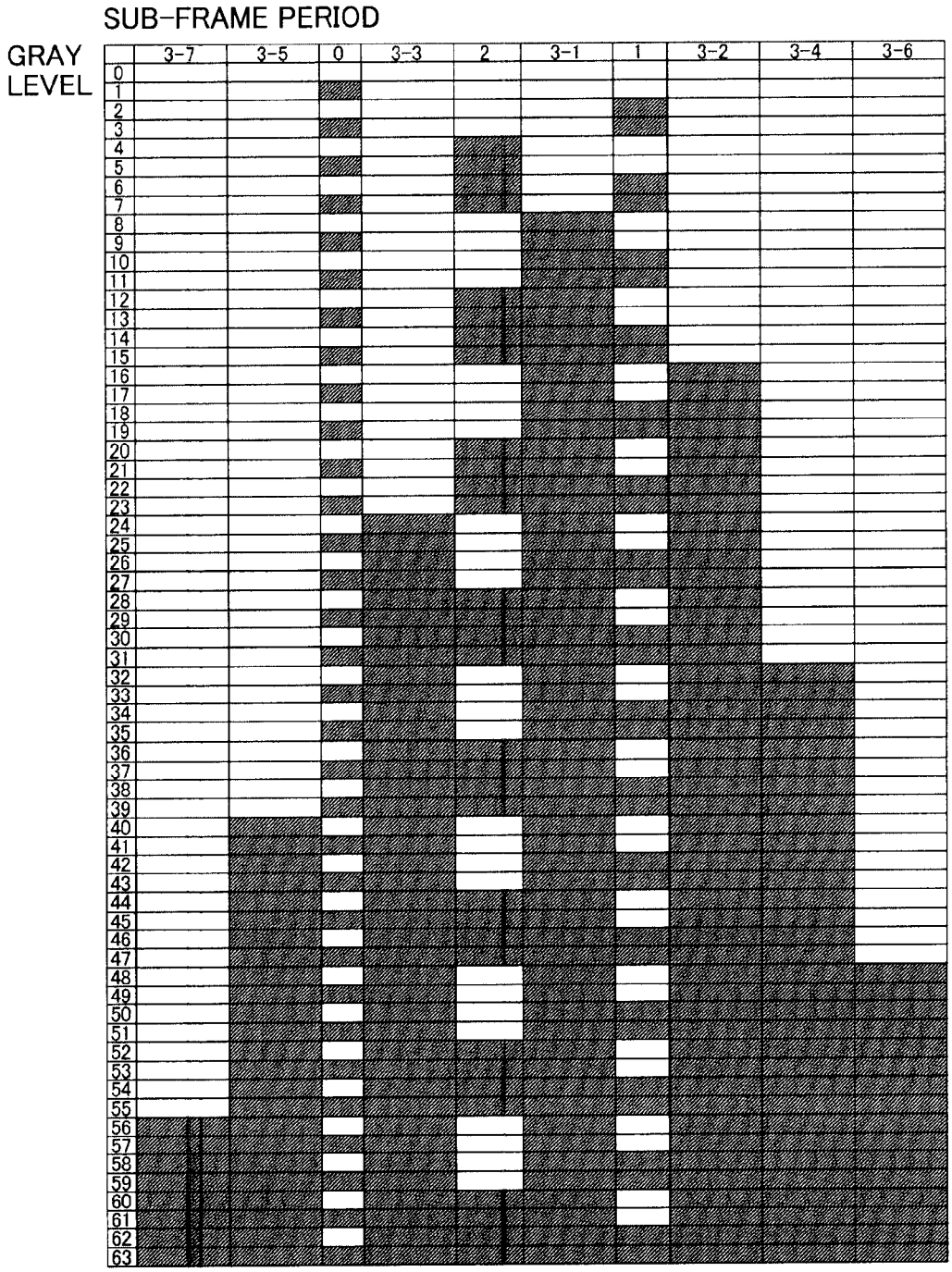
FIG. 27 is a diagram illustrating a light transmission period in a second referential example.
Figure 28:
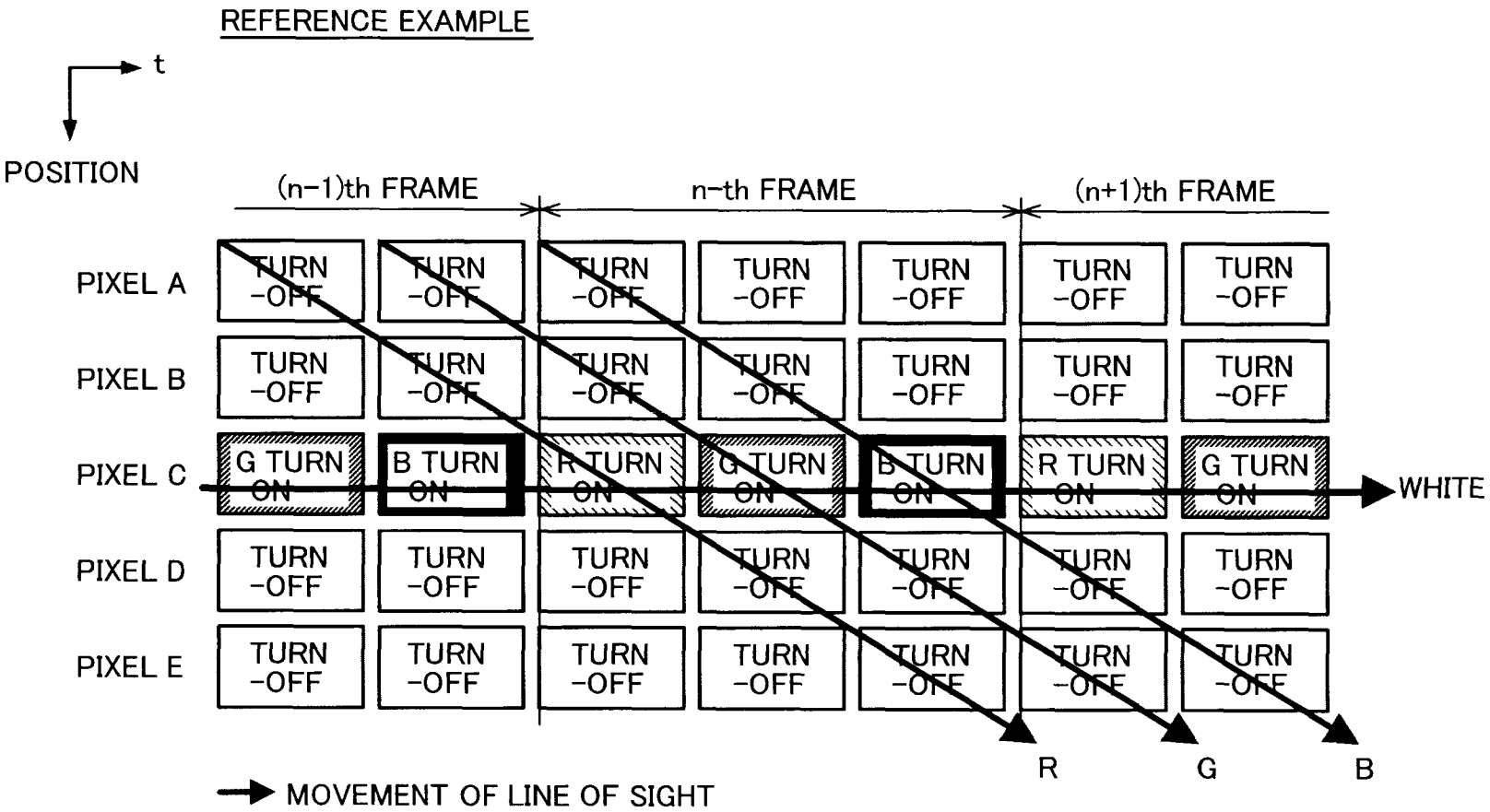
FIG. 28 is a diagram illustrating an occurrence of a color breakup.

To cope with this problem, as shown in FIG. 21, a start timing of one frame period can be adjusted so that the sub-frame periods 0 to 2 that belong to the second group in the pixel A and the sub-frame periods 0 to 2 that belong to the second group in the pixel B appear at the same time. In this embodiment, control is performed so that the second sub-frame period 3-5 appears in the pixel B when the first sub-frame period 3-6 appears in the pixel A. With this operation, the sub-frame periods 0 to 2 that belong to the second group can be turned on at the same timing. In this case, although the pixel A and the pixel B display different frames at a timing at which the sub-frame period 3-7 appears, it causes virtually no problem to the human eyes because the frames are overlapped for about 1/10 of the one frame period. Further, the emission center of the first group is shifted between the pixel A and the pixel B, and their average becomes the position of the sub-frame period 2, and hence the shift of one sub-frame period is effective in terms of the emission center, and the occurrence of the false contour and the color breakup can be suppressed.

With this, the false contour which occurs in the sub-frame periods 3-1 to 3-7 that belong to the first group occurs with reversed brightness and darkness, and hence an average false contour is recognized by the human eyes, resulting in a suppression of the false contour. Further, a color breakup of a complementary color occurs in a checked pattern, and hence an average color breakup is recognized by the human eyes, resulting in a suppression of the color breakup. In addition, by performing a cell feed in the sub-frame periods 3-1 to 3-7 that belong to the first group, a false contour that occurs at a high gray level has a spatially narrow width, resulting in a suppression of the false contour.

While the embodiments of the present invention have been described above, the present invention is not limited to the above-mentioned embodiments, and it should be understood that various modifications may be made thereto by a person skilled in the art.

What is claimed is:

1. A display device, comprising:

a light source for emitting light of a plurality of colors;

an element provided on each pixel, for switching transmission and non-transmission of the light from the light source; and a control unit for driving the light source and the element to represent a gray level based on presence and absence of a light transmission period in each of a plurality of sub-frame periods constituting one frame period for displaying one image, wherein:

the plurality of sub-frame periods are divided into:

a first group to which sub-frame periods with the same length of light transmission periods belong; and a second group to which sub-frame periods with lengths of light transmission periods shorter than the same length of the light transmission periods of the sub-frame periods in the first group and different from each other belong;

among the sub-frame periods that belong to the first group, sub-frame periods having the light transmission period increase in number from a middle of the one frame period toward a start point and an end point of the one frame period in accordance with an increase of the gray level; and the each of the plurality of sub-frame periods comprises a plurality of light transmission periods in which the light of the plurality of colors transmits, respectively.

2. The display device according to claim 1, wherein the sub-frame periods that belong to the first group and the sub-frame periods that belong to the second group are arranged in an alternate manner.

3. The display device according to claim 1, wherein the sub-frame periods that belong to the second group are arranged before and after a sub-frame period having the light transmission period at the lowest gray level among the sub-frame periods that belong to the first group.

4. The display device according to claim 1, wherein a blank period or corresponding one of the sub-frame periods that belong to the second group is arranged between every adjacent two of the sub-frame periods that belong to the first group.

5. The display device according to claim 1, wherein:

in a sub-frame period of the plurality of sub-frame periods arranged on the start point side of the one frame period, the light transmission period for blue color is arranged on the start point side; and in a sub-frame period of the plurality of sub-frame periods arranged on the end point side of the one frame period, the light transmission period for blue color is arranged on the end point side.

6. The display device according to claim 5, wherein, in corresponding one of the sub-frame periods that belong to the second group, corresponding one of the sub-frame periods that belong to the first group is arranged between the light transmission period for the blue color and the light transmission periods for other colors.

7. The display device according to claim 1, further comprising:

a first pixel in which the sub-frame periods having the light transmission period among the sub-frame periods that belong to the first group increase in number on the start point side and the end point side of the one frame period in an alternate manner in accordance with the increase of the gray level; and a second pixel in which the sub-frame periods having the light transmission period among the sub-frame periods that belong to the first group increase in number on the start point side and the end point side of the one frame period in an alternate manner with the increase of the gray level so as to make a symmetrical relation to the first pixel, the first pixel and the second pixel being arranged two-dimensionally in an alternate manner.

8. The display device according to claim 7, wherein the first pixel and the second pixel switch places for each frame period.

9. The display device according to claim 7, wherein a start timing of the one frame period is adjusted so that the light transmission periods of the same length in the sub-frame periods that belong to the second group appear simultaneously in the first pixel and the second pixel.

10. The display device according to claim 1, wherein, at a gray level before the sub-frame periods having the light transmission period increase in number, the light transmission period disappears in one of the sub-frame periods having the light transmission period before the sub-frame periods having the light transmission period increase in number, and the light transmission period appears in a sub-frame period in which a light transmission period newly appears after the sub-frame periods having the light transmission period increase in number.

11. A control method for a display device, the display device comprising:

a light source for emitting light of a plurality of colors;

an element provided on each pixel, for switching transmission and non-transmission of the light from the light source; and a control unit for driving the light source and the element to represent a gray level based on presence and absence of a light transmission period in each of a plurality of sub-frame periods constituting one frame period for displaying one image, the control method comprising:

dividing the plurality of sub-frame periods into:

a first group to which sub-frame periods with the same length of light transmission periods belong; and a second group to which sub-frame periods with lengths of light transmission periods shorter than the same length of the light transmission periods of the sub-frame periods in the first group and different from each other belong;

increasing a number of sub-frame periods having the light transmission period among the sub-frame periods that belong to the first group from a middle of the one frame period toward a start point and an end point of the one frame period in accordance with an increase of the gray level; and providing a plurality of light transmission periods in which the light of the plurality of colors transmits, respectively, to the each of the sub-frame periods.

* * * * *